US010471322B2

(12) United States Patent
Craig

(10) Patent No.: US 10,471,322 B2
(45) Date of Patent: Nov. 12, 2019

(54) BASEBALL TRAINING METHODS AND SYSTEMS

(71) Applicant: Beau James Craig, Santee, CA (US)

(72) Inventor: Beau James Craig, Santee, CA (US)

( * ) Notice: Subject to any disclaimer, the term of this patent is extended or adjusted under 35 U.S.C. 154(b) by 0 days.

(21) Appl. No.: 14/265,358

(22) Filed: Apr. 30, 2014

(65) Prior Publication Data

US 2015/0231471 A1 Aug. 20, 2015

Related U.S. Application Data

(60) Provisional application No. 61/941,783, filed on Feb. 19, 2014.

(51) Int. Cl.
*A63B 69/00* (2006.01)

(52) U.S. Cl.
CPC .. *A63B 69/0002* (2013.01); *A63B 2069/0008* (2013.01)

(58) Field of Classification Search
CPC ..... A63B 23/04; A63B 69/18; A63B 69/00; A63B 69/0022; A63B 21/00047; A63B 63/00; A63B 71/00; A63B 69/0002; A63B 69/0057; A63B 2069/0008; A63B 2069/0062; A63B 2071/0694; A63B 2225/09
USPC ..... 473/422, 415, 446, 478; 482/51
See application file for complete search history.

(56) References Cited

U.S. PATENT DOCUMENTS 2,512,911 A * 6/1950 Benice ..... A63B 21/04 482/127
4,171,805 A * 10/1979 Abbott ..... A63B 22/203 482/132
4,618,139 A * 10/1986 Haaheim ..... A63B 22/203 482/115
4,781,372 A * 11/1988 McCormack ..... 482/70
4,804,178 A * 2/1989 Friedebach ..... A63B 22/0012 482/114
5,328,427 A * 7/1994 Sleamaker ..... A63B 21/4045 482/110
5,338,273 A * 8/1994 Metcalf et al. ..... 482/70
5,368,533 A * 11/1994 Feuer et al. ..... 482/70
5,503,609 A * 4/1996 Bull ..... A63B 21/154 482/51
5,520,598 A * 5/1996 Little ..... A63B 21/0615 482/51
6,042,511 A * 3/2000 Bulloch ..... A63B 21/154 482/51
6,044,768 A * 4/2000 Czinki ..... B64G 4/00 472/131
7,104,901 B1 * 9/2006 Mason ..... 473/446
7,115,073 B2 * 10/2006 Nizamuddin ..... 482/51
7,438,673 B1 * 10/2008 Jones ..... A63B 23/1209 482/51
D626,186 S * 10/2010 Tsai ..... D21/668
7,850,578 B2 * 12/2010 Balaker ..... A63B 21/156 482/131

(Continued)

*Primary Examiner* — Mitra Aryanpour

(57) ABSTRACT

A training device comprising a track having one or more channels extending along part of the length of the track, and one or more skates comprising bearings that can spin freely and are positioned to engage the one or more channels of the track. One or more foot blocks are affixed to the top surface of the one or more skates, wherein the skates can move along the length of the channels in the track.

14 Claims, 26 Drawing Sheets

(56) References Cited

U.S. PATENT DOCUMENTS

| | | | | |
|---|---|---|---|---|
| 7,905,800 | B2 * | 3/2011 | Oneschuk | 473/446 |
| 8,357,061 | B2 * | 1/2013 | Quinn | 473/446 |
| 8,905,868 | B2 * | 12/2014 | Quinn | 473/446 |
| 8,961,373 | B2 * | 2/2015 | Halver | A63B 21/157 482/51 |
| 9,616,283 | B1 * | 4/2017 | Heineck | A61H 1/024 482/127 |
| 2002/0042329 | A1 * | 4/2002 | Nizamuddin | 482/51 |
| 2005/0079956 | A1 * | 4/2005 | Bruno | 482/51 |
| 2015/0231471 | A1 * | 8/2015 | Craig | A63B 69/0002 473/452 |

* cited by examiner

BASEBALL TRAINING METHODS AND SYSTEMS

This application claims the benefit of U.S. Provisional Patent Application No. 61/941,783 filed on Feb. 19, 2014, and U.S. Provisional Patent Application No. 61/817,307 filed on Apr. 29, 2013, both of which are hereby incorporated by reference in their entirety as if set forth herein.

BACKGROUND OF THE INVENTION

Field of the Invention

The invention relates generally to the field of sports training methods and systems. In particular, the invention relates to methods and systems for training baseball players to improve their hitting.

Description of Related Art

Consistently hitting a pitched baseball is often described as one of the most difficult undertakings in sports. A hitter has only a fraction of a second to determine whether a pitch is a ball or a strike, then initiate a swing in the correct plane and the right timing to intersect the path of the ball. The strike zone also has a substantial width and height, so a hitter must be able to swing the bat in a variety of different planes that maximize the likelihood of contacting a pitch in any particular location within the strike zone.

Prior art training systems for hitters fail to effectively train batters to properly pre-load their swing or to bring the bat into the correct swing plane at the right time and maintain it in that swing plane for as long as possible. Various features of the present invention overcome these deficiencies, providing a training method and system that allows hitters at every level to significantly improve their hitting ability.

SUMMARY OF THE INVENTION

A training device comprising a track comprising one or more channels extending along part of the length of the track, and one or more skates comprising bearings that can spin freely and are positioned to engage the one or more channels of the track. One or more foot blocks affixed to the top surface of the one or more skates, wherein the skates can move along the length of the channels in the track. In various exemplary embodiments, the training device further comprising one or more brakes that can be affixed at one or more locations on the track, and one or more elastic cords connecting the one or more skates to provide resistance to movement of the skates in at least one direction.

DETAILED DESCRIPTION OF THE PREFERRED EMBODIMENTS

The following description is presented to enable any person skilled in the art to make and use the invention. For purposes of explanation, specific nomenclature is set forth to provide a thorough understanding of the present invention. Descriptions of specific embodiments or applications are provided only as examples. Various modifications to the embodiments will be readily apparent to those skilled in the art, and general principles defined herein may be applied to other embodiments and applications without departing from the spirit and scope of the invention. Thus, the present invention is not intended to be limited to the embodiments shown, but is to be accorded the widest possible scope consistent with the principles and features disclosed herein.

Baseball is a game of science. The laws of physics dictate how the ball moves and only by understanding the basic physics of ball flight and developing a swing that takes them into account can a hitter develop a consistent, effective swing. As can be seen from the movement of pitches based on the spin imparted by the pitcher, because of its raised seams and materials the spin of a baseball dramatically affects its flight.

Figure 1A:
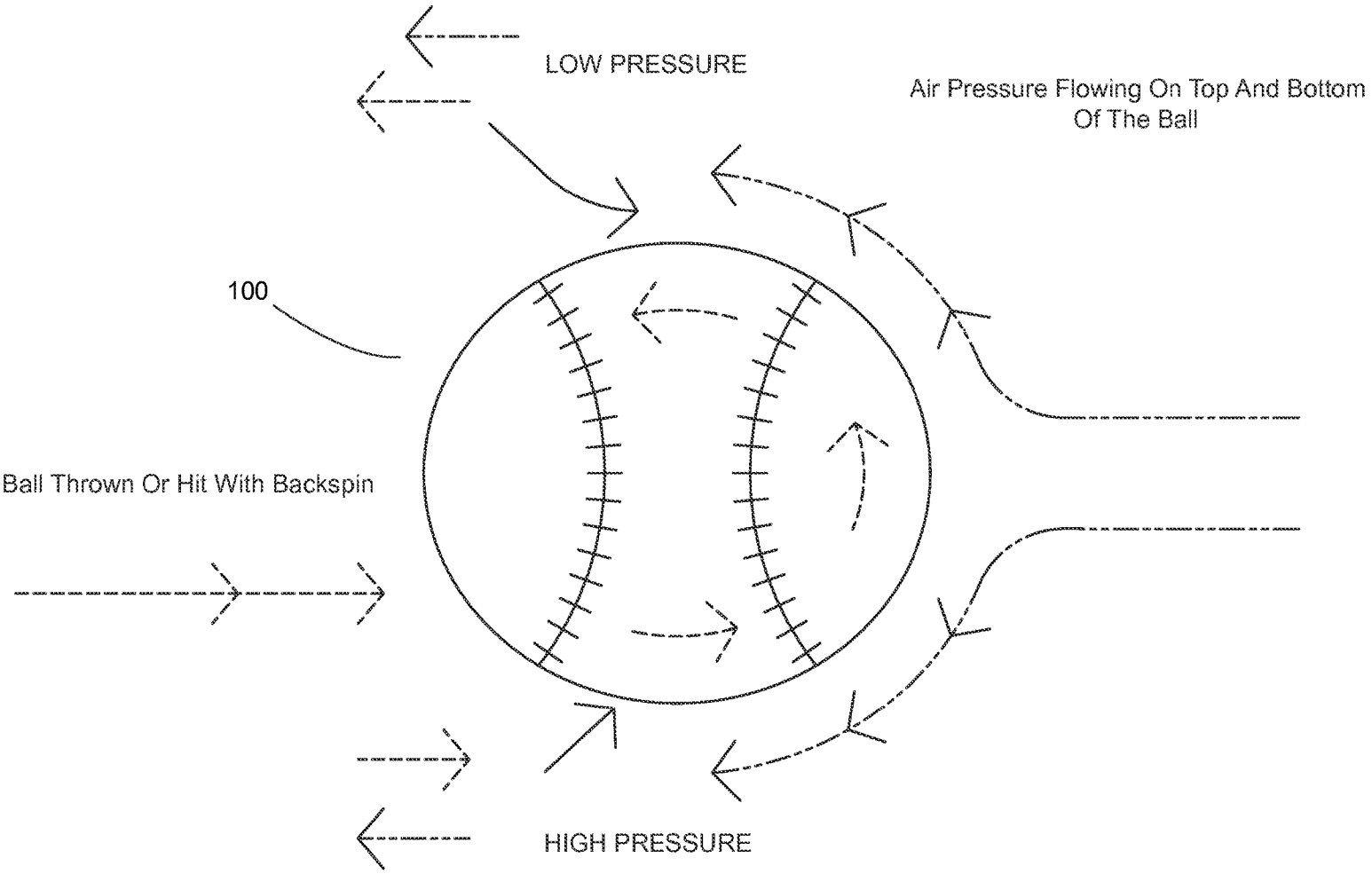
FIG. 1A is a diagram showing the impact of spin on air pressure around a moving ball.
Figure 1B:
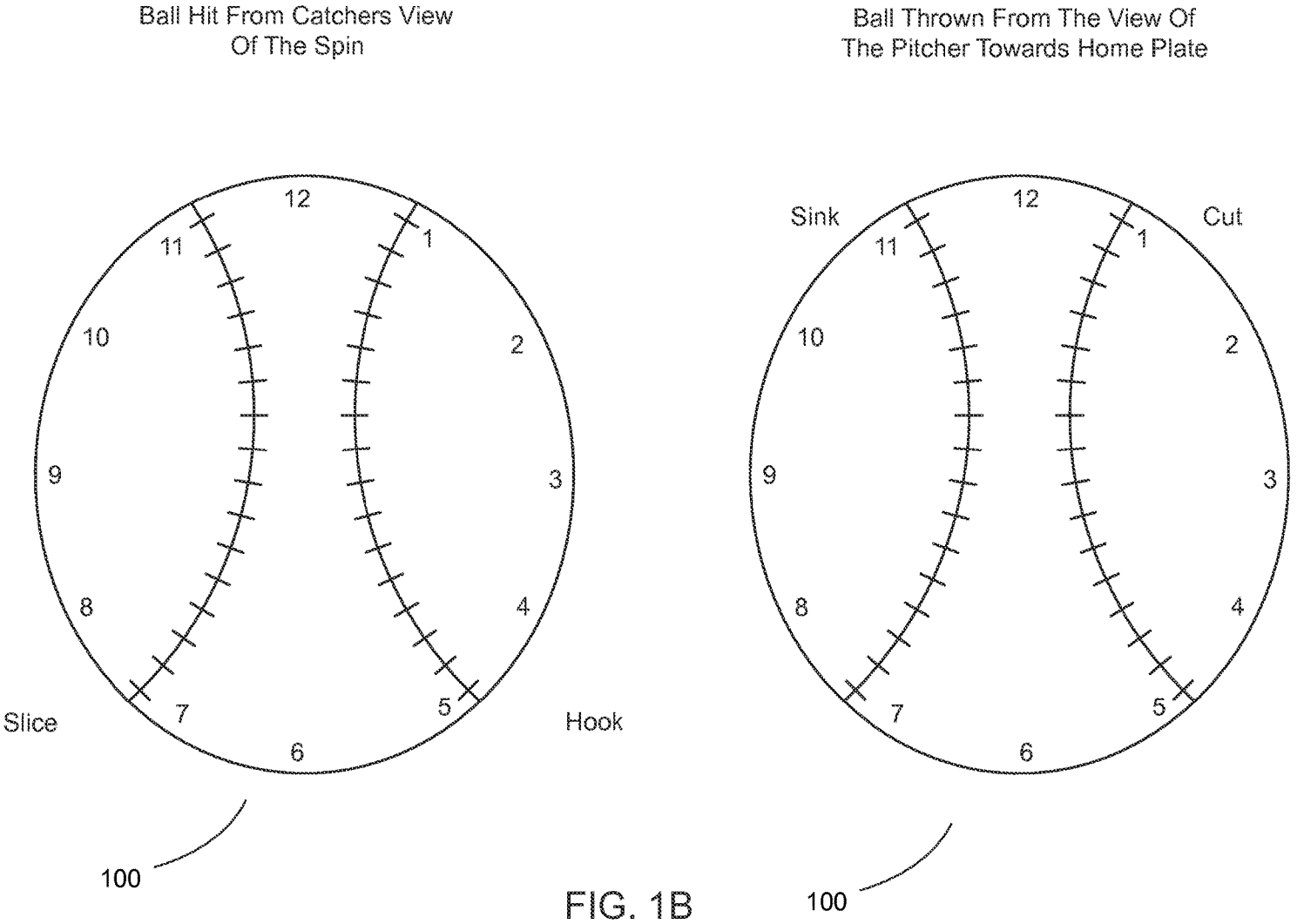
FIG. 1B is a diagram showing analog clock positions on a baseball as seen from the catcher's point of view and from a pitcher's point of view.
Figure 2:
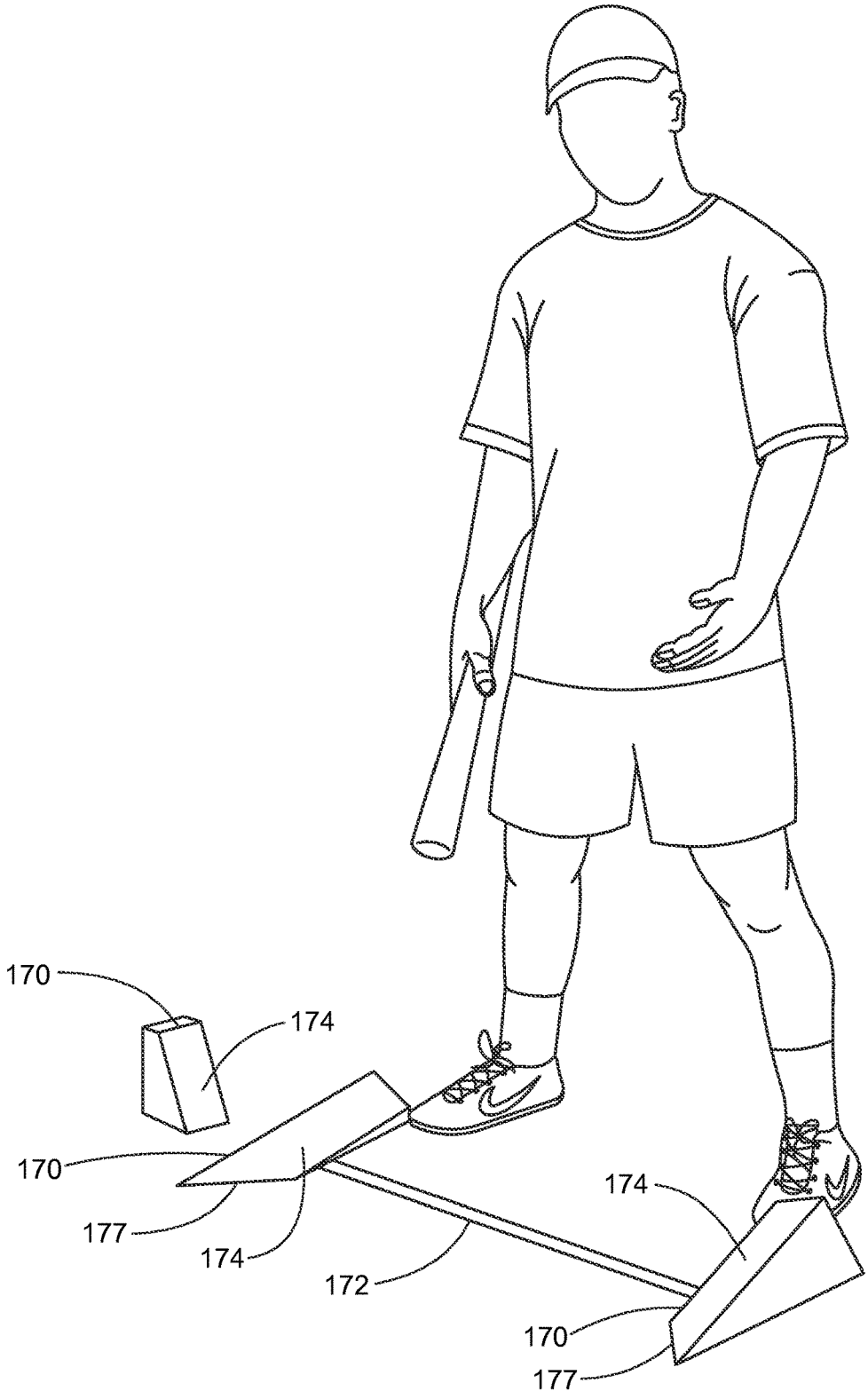
FIG. 2 is a diagram showing an exemplary embodiment and arrangement of foot blocks in accordance with the invention.

Referring to FIGS. 1A and 1B, a baseball 100 in flight is effectively pushing through the air on its flight path. A ball that is spinning will create an air pressure differential that can materially affect its flight path. For example, if a ball has pure backspin, the spinning movement of the ball allows the air on the top side of the ball spinning away from the direction of travel to pass more easily, reducing the air pressure the that side of the ball. At the same time, the spinning movement of the ball increases the air pressure on the bottom side of the ball spinning toward the direction of travel, increasing the air pressure on that side of the ball. The result is commonly referred to as the Magnus force, causing the ball to move away from high pressure and toward lower pressure.

A ball that is hit squarely and below center—sometimes described as "6 o'clock" in reference to the position on an analog clock—will leave the bat with backspin. Because this backspin reduces the pressure on the top side of the ball and increases it on the bottom side, a ball with backspin will tend to rise during flight. A ball hit squarely and above center—at 12 o'clock—will have topspin, which will cause the ball to curve downward. A ball hit below center and at a slight angle will come off the bat with off-axis backspin, causing it to rise and curve. This results in a ball flight that slices or hooks. The amount of slice or hook depends on how far off-axis the ball is struck, such that a ball hit by a right-handed batter at 7 o'clock will tend to slice away from the hitter and while a ball hit at 8 o'clock will slice more dramatically. A ball hit perfectly square will leave the bat with little or no spin and may move erratically like a knuckleball pitch.

As a result, in most instances hitters want to strike the ball slightly below center and as squarely as possible to establish a good launch angle and backspin to increase the distance the ball travels and prevent it from hooking or slicing foul. Both the ball and bat present curved surfaces, so even minor up or downward shifts in the point of impact can dramatically impact the launch angle and spin. In addition, many baseball and softball bats have a relatively small barrel area or sweet spot in which the bat will impart the most energy to the ball. This sweet spot is generally smaller than the width of the plate. Thus, the goal for hitters is to put the sweet spot of the bat in the strike zone at the correct time and place, and on a plane so it will strike the ball square and slightly below center with maximum bat speed.

To achieve this goal, the hitter must be able to accelerate the barrel of the bat into the correct swing plane for the particular pitch thrown almost instantly. This requires the batter to pre-load the swing to maximize the potential energy that each critical part of the hitters body—legs, core muscles, and arms—can convert to kinetic energy in the form of bat speed. The swing itself must then manage that conversion of potential energy into kinetic energy in a controlled way that puts the sweet spot in the right place at the right time.

Figure 3:
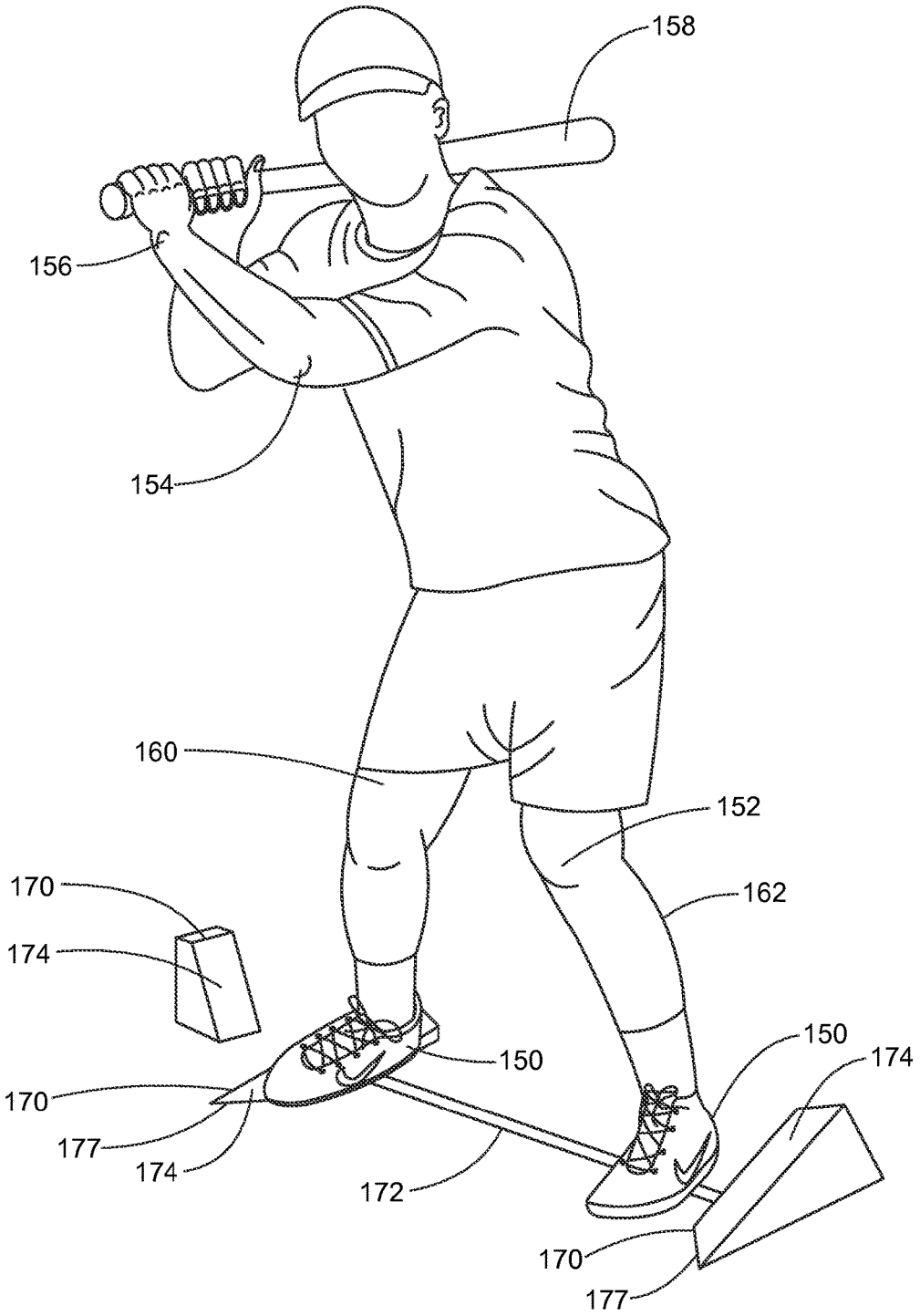
FIG. 3 is a diagram showing a batter using an exemplary embodiment and arrangement of foot blocks in accordance with the invention.
Figure 4:
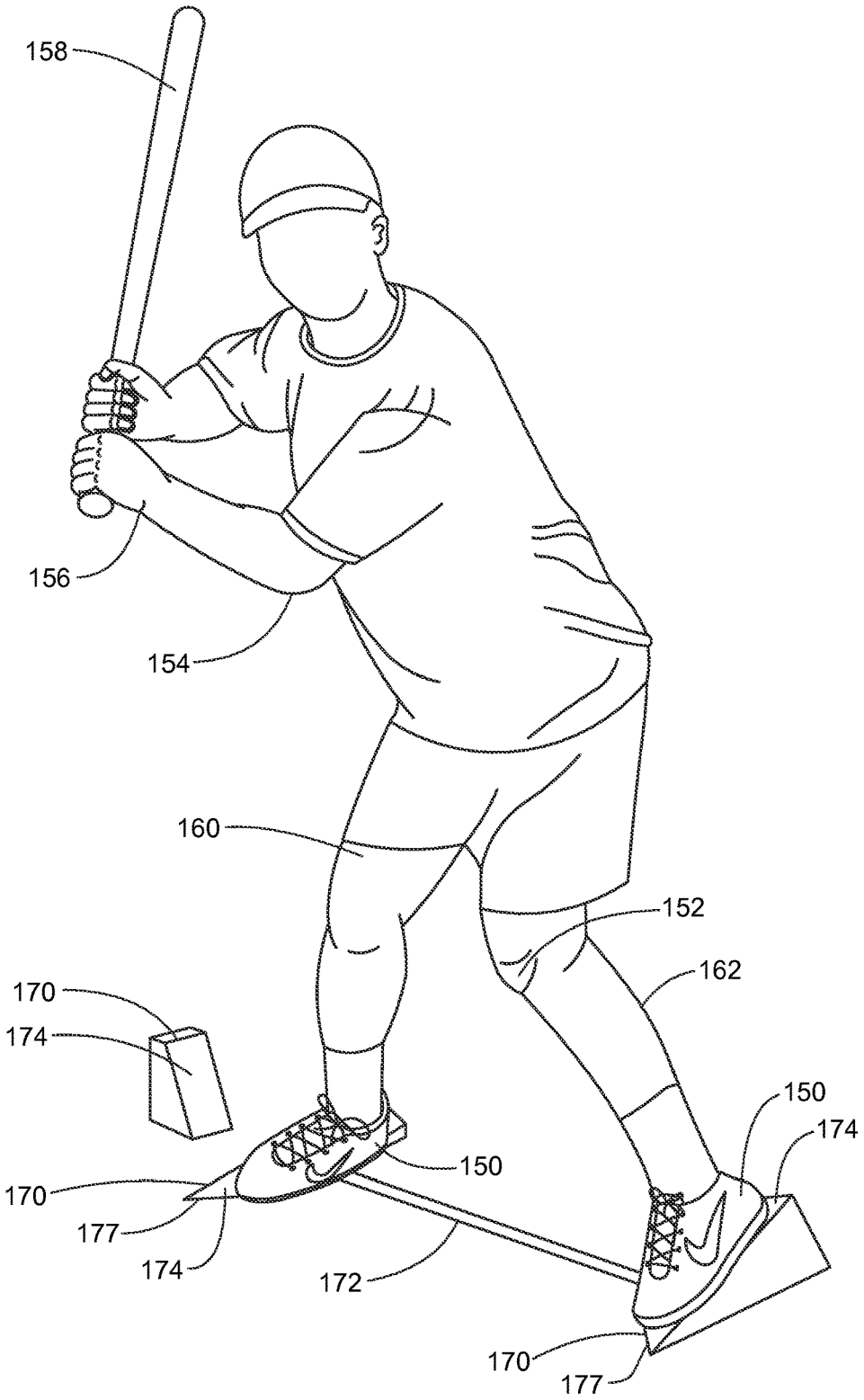
FIG. 4 is a diagram showing a batter using an exemplary embodiment and arrangement of foot blocks in accordance with the invention.
Figure 5:
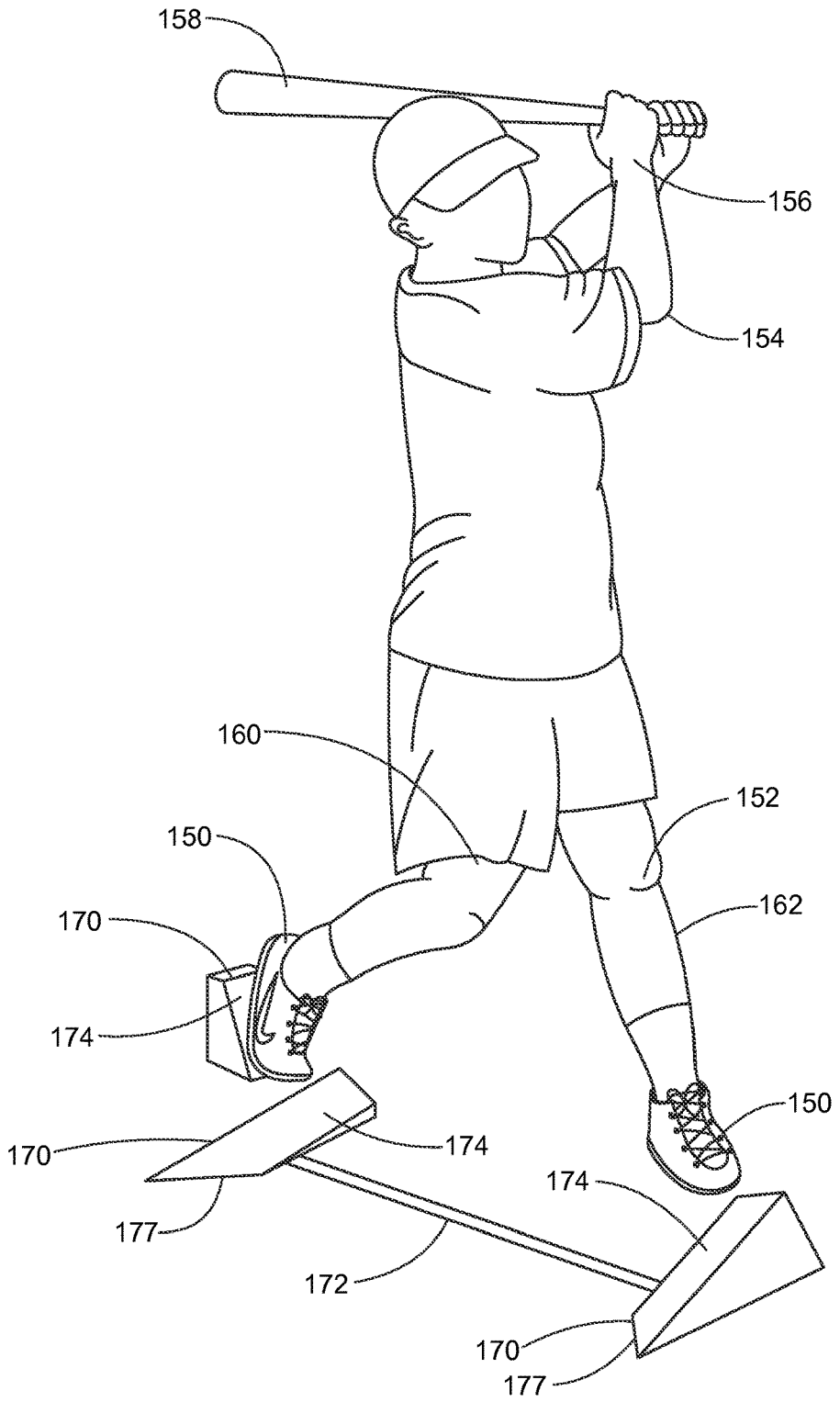
FIG. 5 is a diagram showing a batter using an exemplary embodiment and arrangement of foot blocks in accordance with the invention.

Referring to FIGS. 3 through 5, a batter's swing can be broken down into several stages, some of which are static and some of which are dynamic. While there are many variations in terminology used by different coaches and hitters, these stages can be described as: (1) athletic stance (static—see FIG. 3); (2) load connection (dynamic); (3) athletic load (static—see FIG. 4); (4) swing-plane connection (dynamic); (5) athletic fire (dynamic); and (6) athletic finish (static—see FIG. 5).

The athletic stance is the hitter's stance in the batter's box, and it is the static starting point for the swing. A good athletic stance puts the batter's feet 150 in a comfortable position slightly wider than shoulder width, weight on the balls of the feet. Knees 152 are bent and slightly inside their feet to establish a solid connection with the ground. Elbows 154 and wrists 156 are at 90-degree angles and the knuckles are aligned on the bat 158.

The load connection is the dynamic movement of the batter from their athletic stance to the athletic load in a single fluid motion. The batter brings the bat 158 to a vertical or substantially upright position so that gravity will help pull the bat down into the correct swing-plane, and at the same time strides off the back foot, winding the hips and bringing the knees farther inside of the feet and establishing a compound angle in both ankles. This movement puts the batter into athletic load, ready to instantly initiate a swing if the pitch is a strike.

The swing-plane connection is the dynamic movement that brings the bat into a particular swing-plane based on the location and type of pitch. As used here, the swing-plane refers to an imaginary disc shaped plane that reflects the path of the bat through a swing. There are a wide range of common swing-planes that may be used depending on the location and movement of the pitch.

The athletic fire or the swing itself is the dynamic movement of the batter as the bat 158 is brought through the swing-plane. During this phase, the batter's hips and core unwind, arms and hands come through and extend as necessary, wrists and palms rotate over, and the lower body drives off the back foot which has used the firm ground connection established in the athletic load phase. The femur 160 of the back leg is pointing down and the back foot 150 pivots into a deeper compound angle. The front leg 162 is extended straight out at an angle and the foot 150 is firmly planted as the bat 158 comes through the strike zone. The athletic finish is the position of the batter at the end of the swing with their body balanced and ready to push out of the batter's box and down the line toward first base.

Referring now to FIGS. 2 through 10, in various exemplary embodiments, the hitting training device comprises one or more foot blocks 170 that can be used to establish and maintain proper foot, ankle, and lower body position for hitting. As described separately below, such foot blocks 170 can also be used for throwing and fielding training. In various exemplary embodiments, the foot blocks 170 may include a single block cut at various angles, multiple blocks cut at various angles, or one or more blocks attached to a positioning band 172 or similar device.

In various exemplary embodiments, a foot block 170 comprises a hollow or solid block shaped to rest on the ground such that when a user places the ball of their foot on the ground and the rest of their foot on the block 170, it naturally positions the user's knee inside of their foot and puts their ankle into a compound angle. For example, the foot block 170 may be formed with a foot surface 174 that slopes down and in relative to the user's body to put weight on the ball of the foot with the knee inside and the heel off the ground.

One or more foot blocks 170 may be used to help train batters to adopt a good athletic stance and/or a good athletic load as described herein. A batter can use a single foot block while practicing to establish good rear foot, ankle, and knee position in the athletic stance, with weight on the ball of the foot, a compound angle at the ankle, and knee inside the foot. A batter can use two foot blocks 170 on a positioning band 172 or platform 180 to practice load connection. For example, starting with the rear foot on the rear block as described above and the front foot on the band 172, the batter can practice load connection, brining the front foot into position on the forward foot block 172 in athletic load. The blocks allow the batter to repeat the load connection movement from athletic stance to athletic load repeatedly, developing muscle memory for the correct movement and athletic load positioning.

One or more foot blocks 170 may also be used to help batters with their athletic finish. At athletic finish, the batter's back foot should be on the ball of the foot, toes pointing forward, with the heel up at a sharp angle.

It will be readily understood by those of skill in the art that foot blocks 170 can be created with a wide range of angles accommodate various stances, swings, sizes, and body types. The angle of the foot surface relative to the ground can vary from greater than zero to nearly vertical, and can incorporate a range of suitable compound angles. In various preferred embodiments, foot blocks 170 for use in establishing proper positioning for initiating action have a foot surface angled between and 10 and 45 degrees from the plane of the ground. Foot blocks 170 with substantially steeper angles may be suitable for other applications such weight transfer or for the athletic finish of a swing as described above and shown in FIG. 5. In various exemplary embodiments, an angled leading edge 177 may be provided to promote good contact between the ball of the foot and the ground and reinforce correct positioning.

Foot blocks 170 as disclosed herein can also be made from almost any solid material, including without limitation wood, plastic, rubber, vinyl, etc. In various exemplary embodiments, foot blocks may have one or more holes passing through the block for use in storing the blocks or affixing them to the ground by means of a stake or other fastener. Such holes will also reduce weight without any affect on performance. Foot blocks can be affixed to any surface or object by any suitable fastening means including stakes, screws, nut and bolt, hook and loop, or other fastener. Foot blocks as described herein can also be combined and formed as a single foot block or broken up into small foot blocks as desired.

Referring to FIGS. 6 through 10, in various exemplary embodiments foot blocks 170 can also be used together and configured such that they can be used while the hitter goes through the entire movement such as a swing of a bat. The foot blocks 170 position the user's toes and balls of their feet on the ground and shape the position of the ankles, knees, and hips to establish correct alignment and angulation. Thus, the foot blocks 170 shape of the neuromuscular system of the hitter to establish a powerful and efficient kinematic chain of movements up through the legs, hips, and core.

Foot blocks 170 may be attached to a platform or base 180 or base either permanently or removably using any suitable fastening structures including without limitation clamps, clips, hook-and-loop fasteners, dowels, tabs, screws, nails, adhesives, etc. The base 180 may include one or more holes to allow it to be anchored to a surface. For example, when used on a dirt or grass field a spike or other device can be placed through the holes and pounded into the ground to hold the base in place. Two base and foot block combinations can be set up at an appropriate distance apart to used together for the hitter's back and front foot respectively.

Various single foot blocks 170 or combinations of foot blocks can be used together in a variety of different positions. For example, one or more small compound angle foot blocks may be used together with one or more larger foot blocks on the ground or on a base 180. The various foot blocks can be used in different arrangements and orientations to provide a wide range of training options. In one example, a small compound angle foot block designed to establish a good athletic load with the knee inside can be used with one or more larger foot blocks cut at a steep angle on one side in the range of 60-85 degrees and a vertical or 90 degree angle on the other to establish correct body position and a balanced athletic finish. The foot blocks can be arranged in various different configurations.

Figure 6:
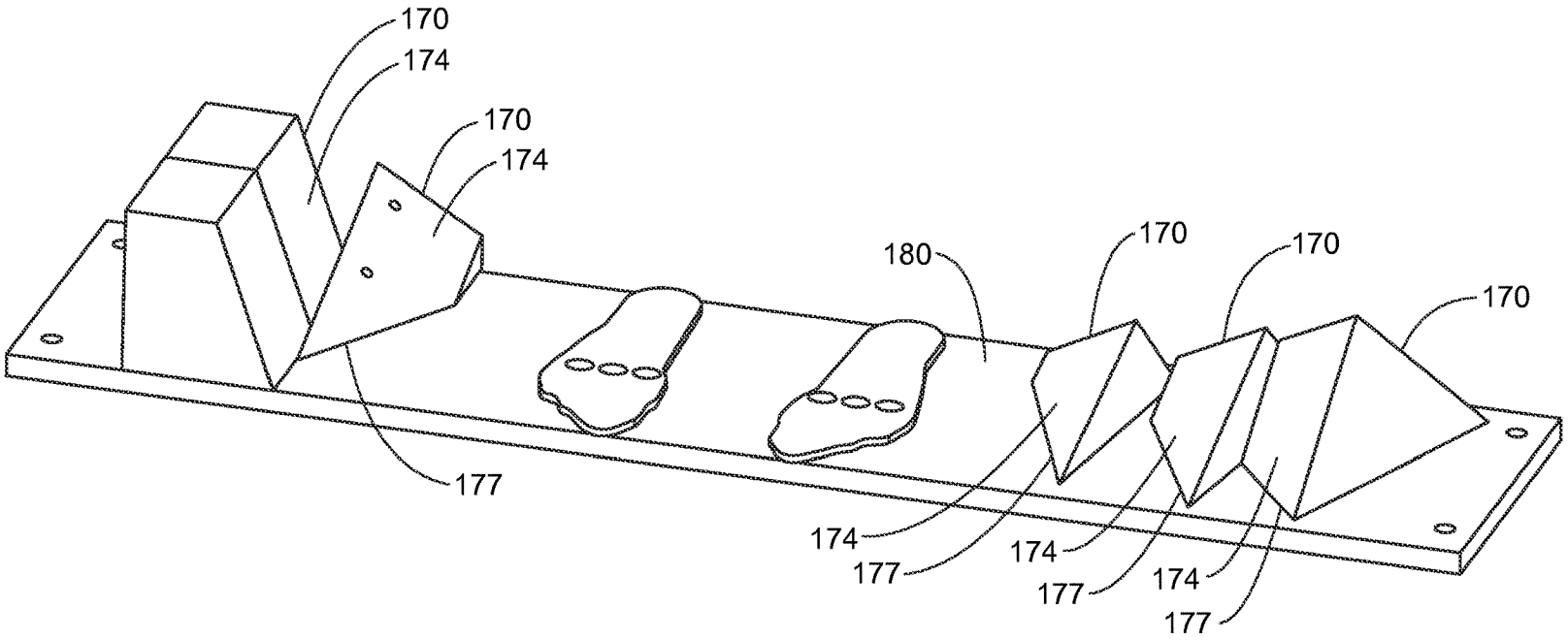
FIG. 6 is a diagram showing various configurations and arrangements of foot blocks in accordance with the invention.
Figure 7:
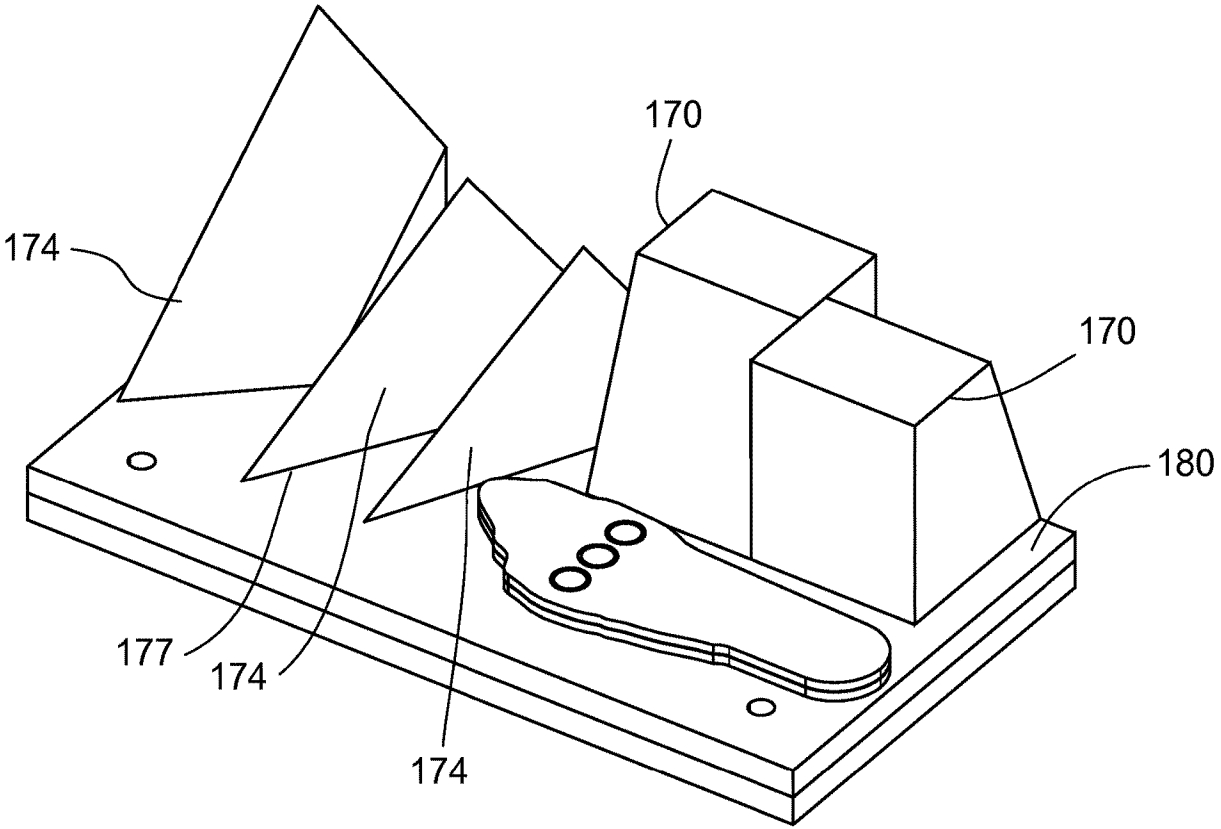
FIG. 7 is a diagram showing an arrangement of foot blocks in accordance with the invention.
Figure 8:
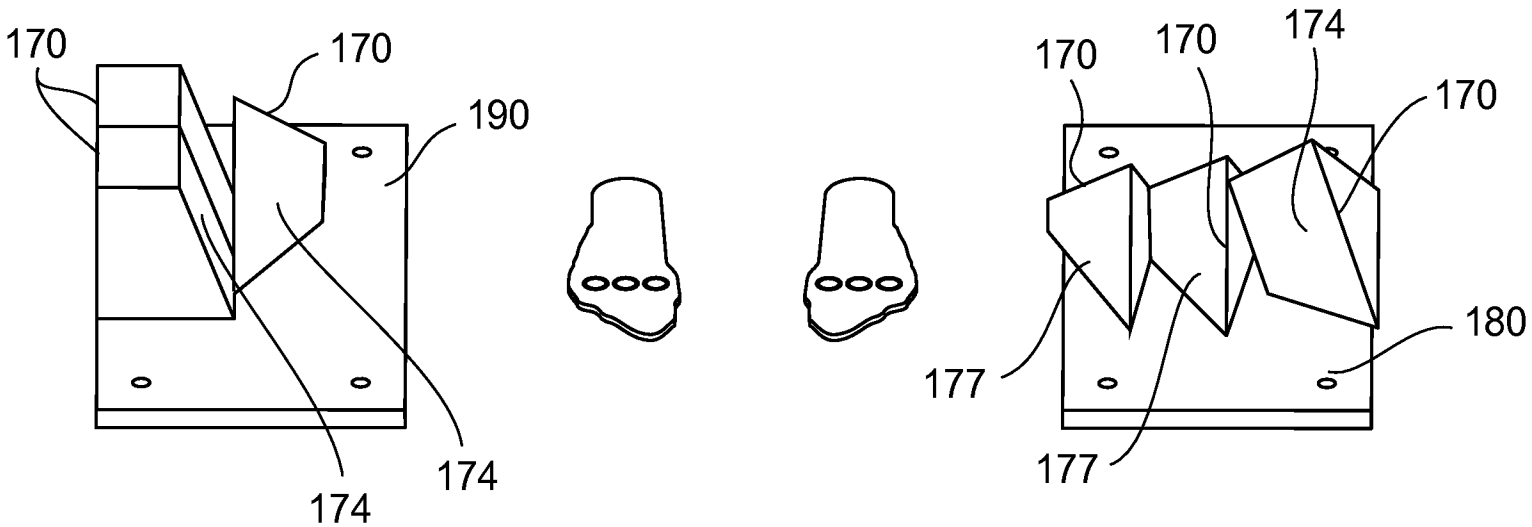
FIG. 8 is a diagram showing an arrangement of foot blocks in accordance with the invention.

Referring to FIGS. 6 and 8, in one example, two larger foot blocks 170 are arranged behind a compound angle foot block 170 with both presenting an approximately 70 degree angle on the side adjacent to the compound angle foot block. The compound angle foot block puts the user in the correct position at athletic load, while the larger foot blocks guide the user's foot through the athletic fire and into a balanced athletic finish planted on the ball of the foot. As seen in the figures, the front compound angle foot block puts the user's back foot in a correct athletic load. At the finish, the user's back foot is balanced on the ball of the foot in the correct position.

Figure 9:
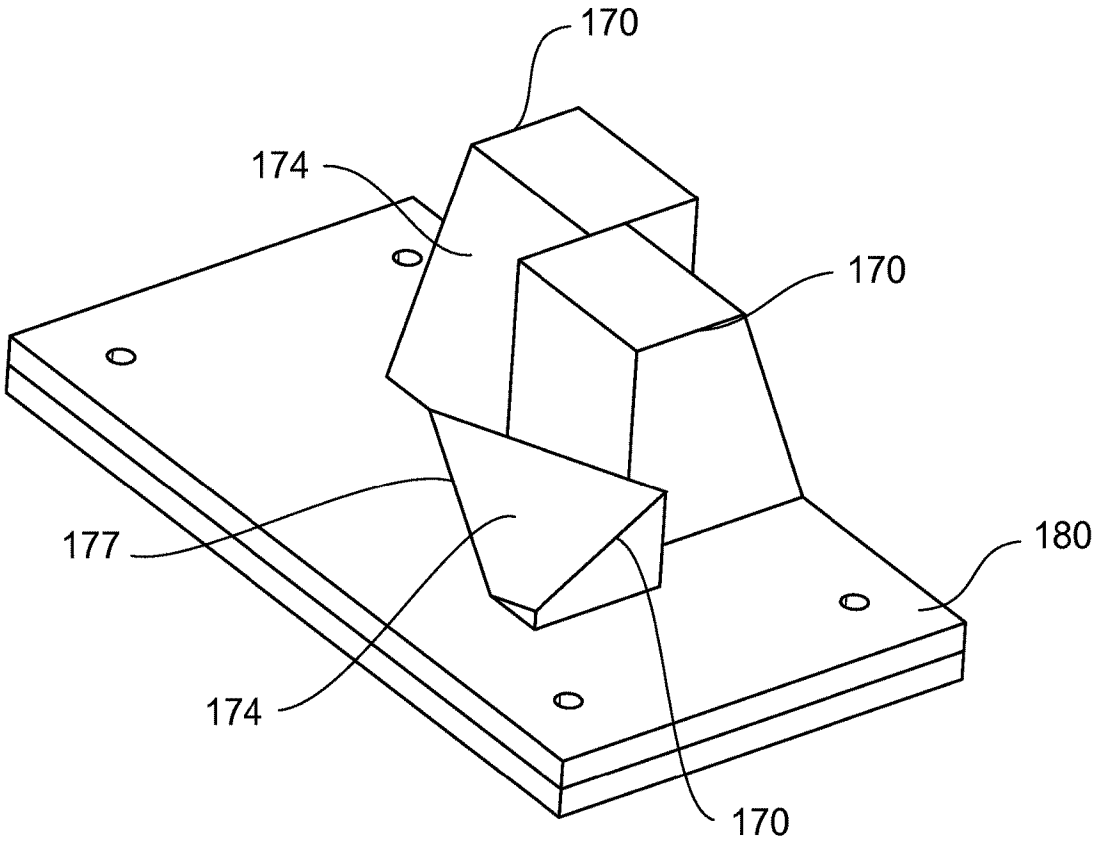
FIG. 9 is a diagram showing an arrangement of foot blocks in accordance with the invention.
Figure 10:
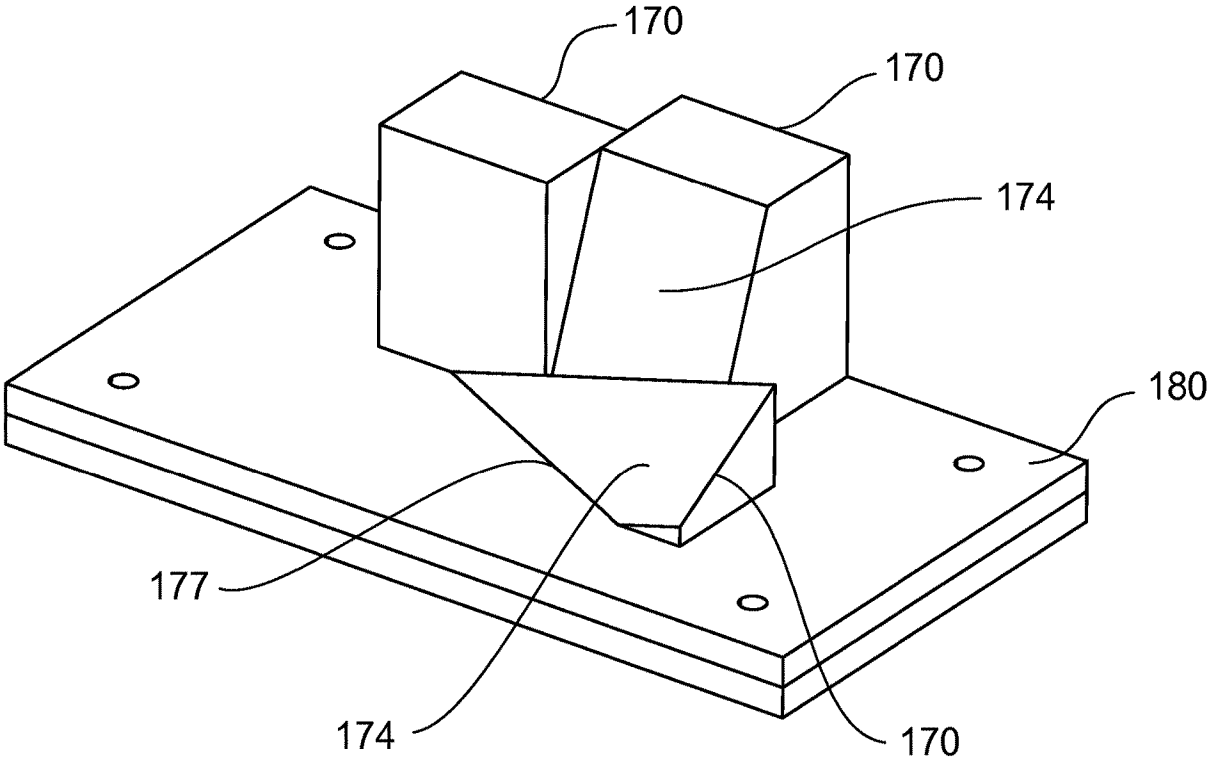
FIG. 10 is a diagram showing an arrangement of foot blocks in accordance with the invention.

In the alternative shown in FIGS. 9 and 10, the larger foot blocks 170 positioned at the back of the compound angle foot block can be reversed so that one presents a vertical side toward the compound angle foot block. This forces the user to perform a better pivot and weight transfer or their back foot will catch on the block. In a correct transfer the user's foot will clear the vertical side of the first larger foot block and correctly land on the angled surface of the second larger foot block. If the swing is not performed correctly, the user's heel will catch on the vertical side of the first larger foot block.

Referring to FIG. 8, two base 180 and foot block 170 combinations can be set up at an appropriate distance apart to used together for the hitter's back and front foot respectively. The foot blocks can also be set up in an alternative arrangement of the blocks for the back foot for use with a left-handed hitter for training the hitter to transition from their swing and start to move down the first-base line. In this arrangement, the two larger foot blocks are both arranged with the vertical or 90 degree side adjacent to the compound angle foot block. This promotes correct positioning of the back leg through the swing, then the back foot can clear the blocks and get to the correct athletic finish in a position to quickly move down the first base line.

Referring to FIGS. 11A through 22, in various exemplary embodiments, foot blocks can be used in connection with dynamic systems that allow the foot blocks to move and if desired provide resistance as the batter swings or uses the system for physical training. In various exemplary embodiments, the foot blocks may be directly affixed to a dynamic training system, or affixed to a base as described earlier. The use of a common base allows the same set of blocks to be used in a fixed position or with a dynamic system.

In one exemplary embodiment as shown in FIGS. 11A through 19D, a dynamic training device 200 comprises a track 202 and foot blocks 204 mounted on movable skates 206 that are capable of sliding along the track. The skates 206 may be equipped with a variety of different types and configurations of foot blocks 204. The foot blocks 204 may also include additional training accessories such as circular pivoting disc 208 that promote specific movements or positioning. Foot blocks 204 may also include grip tape on their surface or other features to control frictional engagement with the user's foot.

Figure 13:
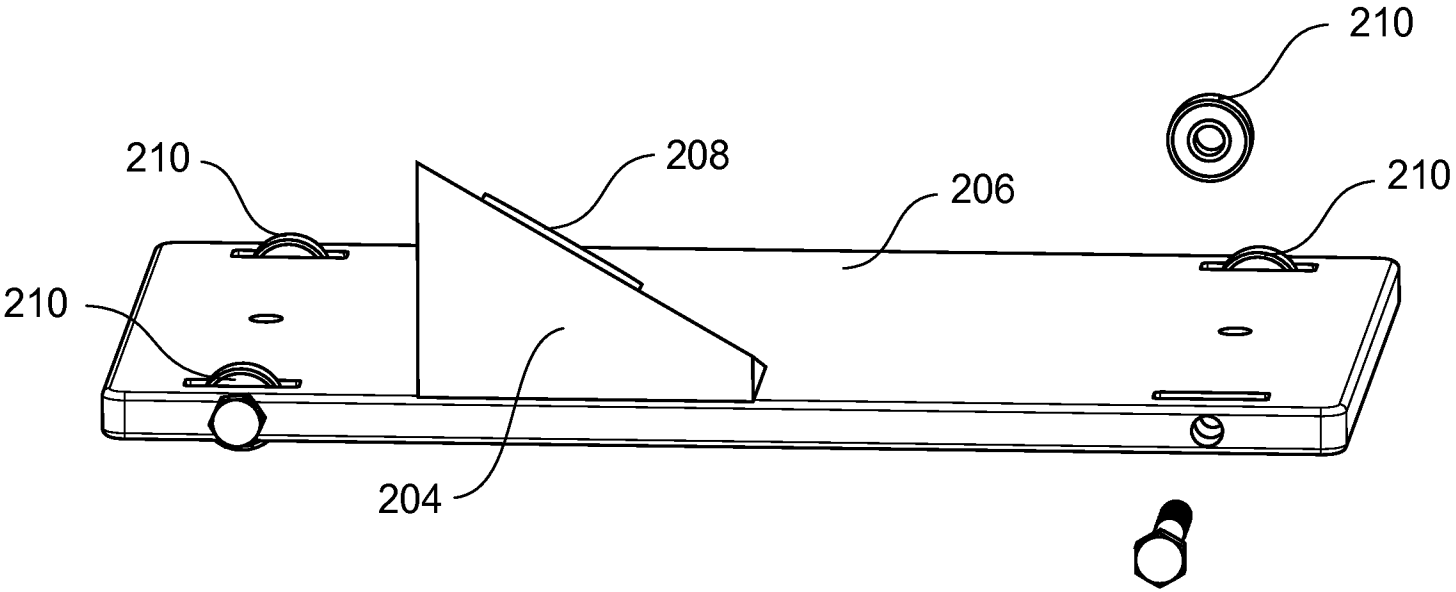
FIG. 13 is a diagram showing a dynamic training system in accordance with the invention.

As shown in greater detail in FIG. 13, the skates 206 may be equipped with bearings or wheels 210, attached via any suitable attachment means including bolts and nuts. In various exemplary embodiments, the wheels or bearings 210 may be inset or recessed in the skates to establish stable, moveable platforms of the foot blocks 204. The skates 206 may be formed from any suitable material.

The bearings or wheels 210 may be positioned on the skates so that they drop into one or more channels 212 running lengthwise in the track. Such channels may extend over the entire length of the track or only some portion thereof. The channels may be of any suitable shape, size, and profile, including u-channel, t-channel, etc. The channels may also be used to capture t-bolts 214 or similar hardware that can be used to fix the position of skates or other mechanisms on the track. In various exemplary embodiments, t-bolts can be slid into a channel 212 with a T-shaped profile such that the threaded bolt extends upward. The skate 206 or other mechanism such as a brake plate/shim 216 having a hole can then be placed such that the T-bolt passes through it, and a knob 218 can be attached and tightened down to fix the position of the skate or other mechanism.

Figure 14:
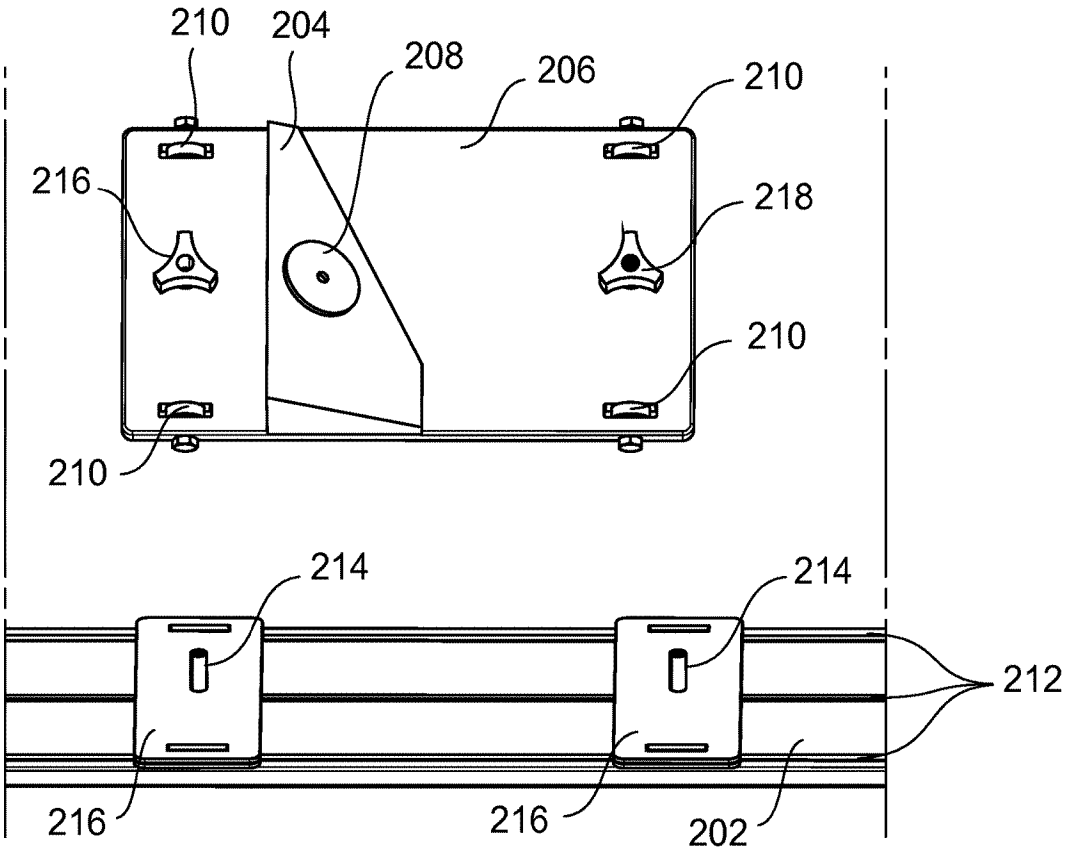
FIG. 14 is a diagram showing a dynamic training system in accordance with the invention.
Figure 15:
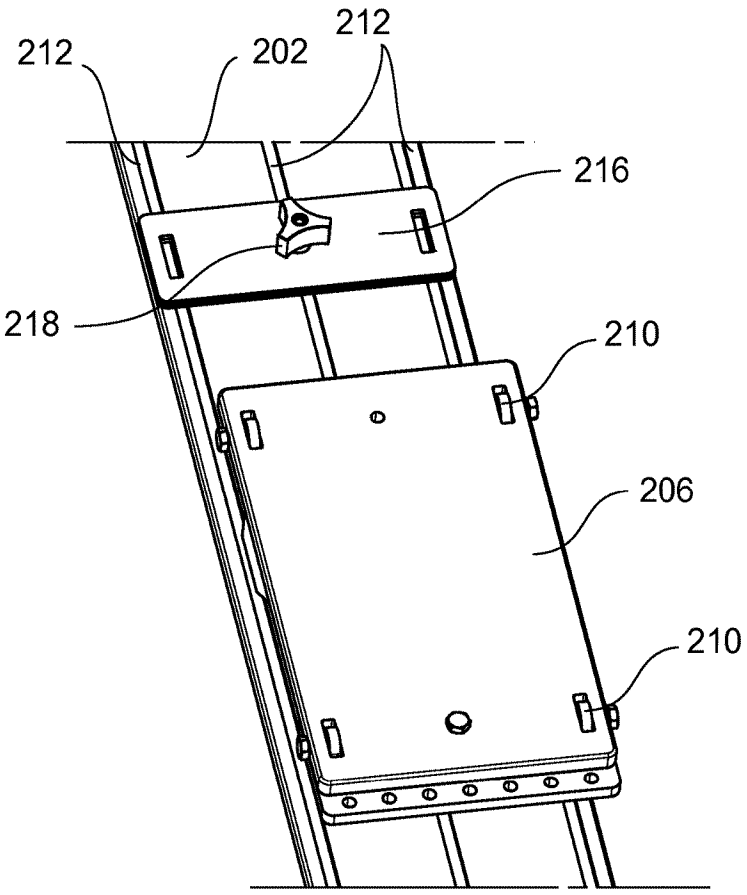
FIG. 15 is a diagram showing a dynamic training system in accordance with the invention.
Figure 16:
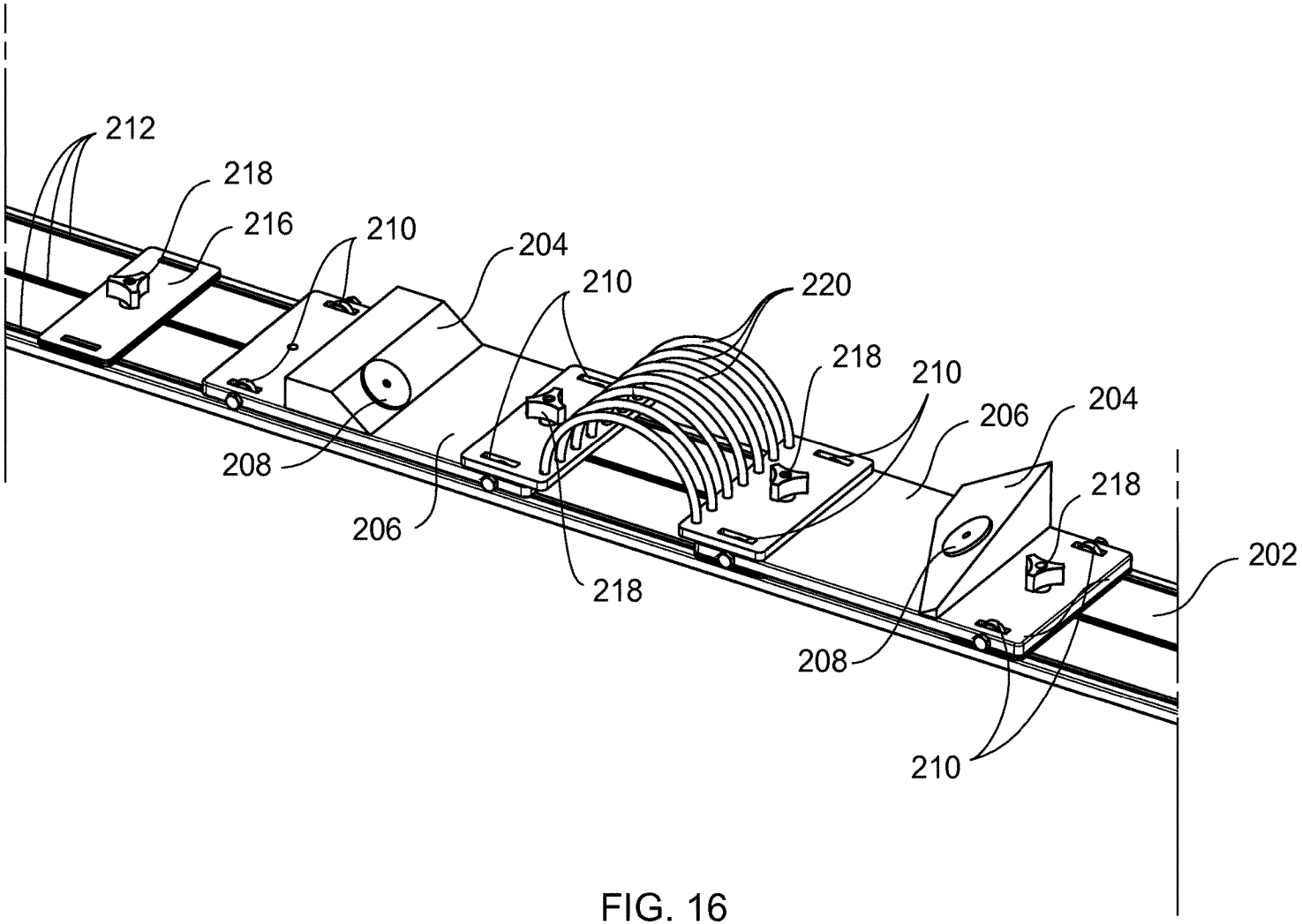
FIG. 16 is a diagram showing a dynamic training system in accordance with the invention.
Figure 17:
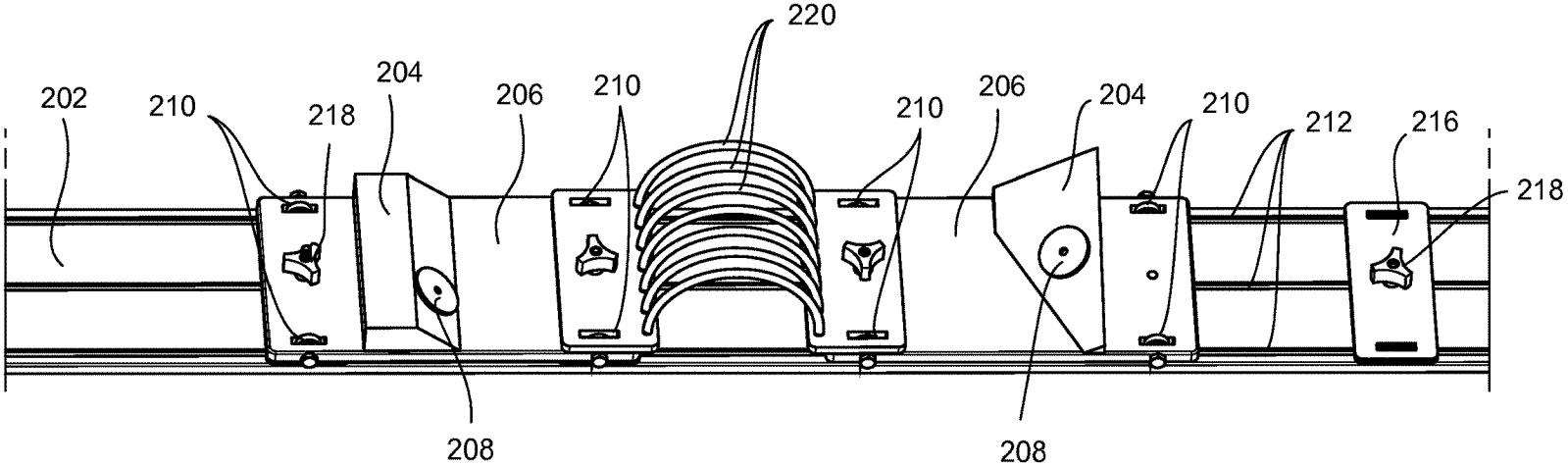
FIG. 17 is a diagram showing a dynamic training system in accordance with the invention.

Such a system can be used to fix the position of skates 206, brake plates/shims 216 that stop linear movement of the skates 206, or any other suitable device that could be affixed to the track. As shown in FIGS. 14 and 15, brake plates/shims 216 can be placed under the skates 206 to prevent operation of the bearings or wheels 210 and fix the position of the skates 206, or affixed separately at different locations on the track 202 to limit the range of movement of the skates 206.

In various exemplary embodiments, the skates 206 may be flexible such that when sufficient weight is placed on the foot block attached to the skate it will flex and come into contact with the track 202. The flexibility of the skate may be calibrated to provide a braking mechanism such that when a user's weight is equally distributed on two skates, the will not flex sufficiently to contact the track. However, when the user's weight is entirely on a single skate, it will flex and come into contact with the track such that the skate will resist movement. This provides a safety feature that allows the user to better control movement of the skates.

Figure 11B:
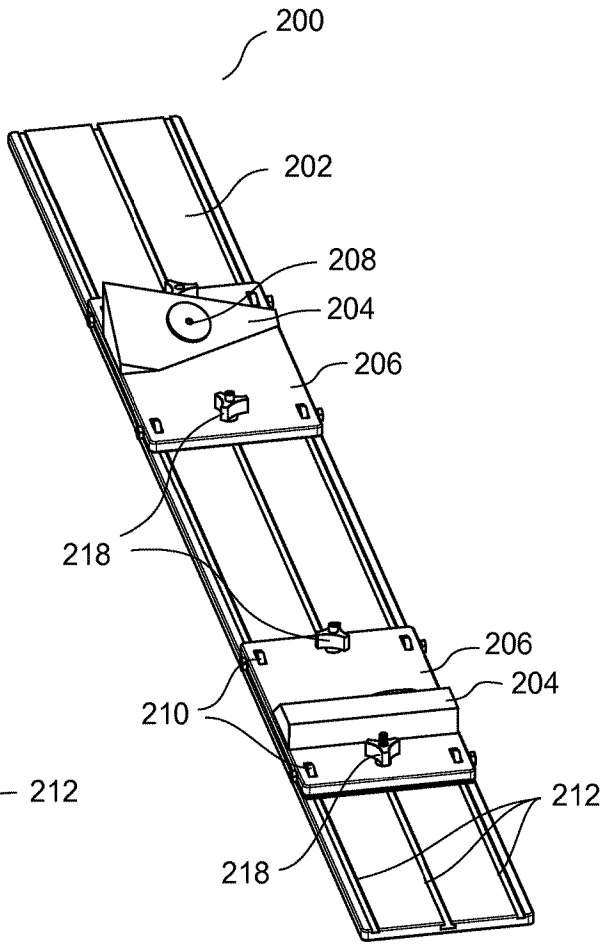
FIG. 11B is a diagram showing a dynamic training system in accordance with the invention.
Figure 11A:
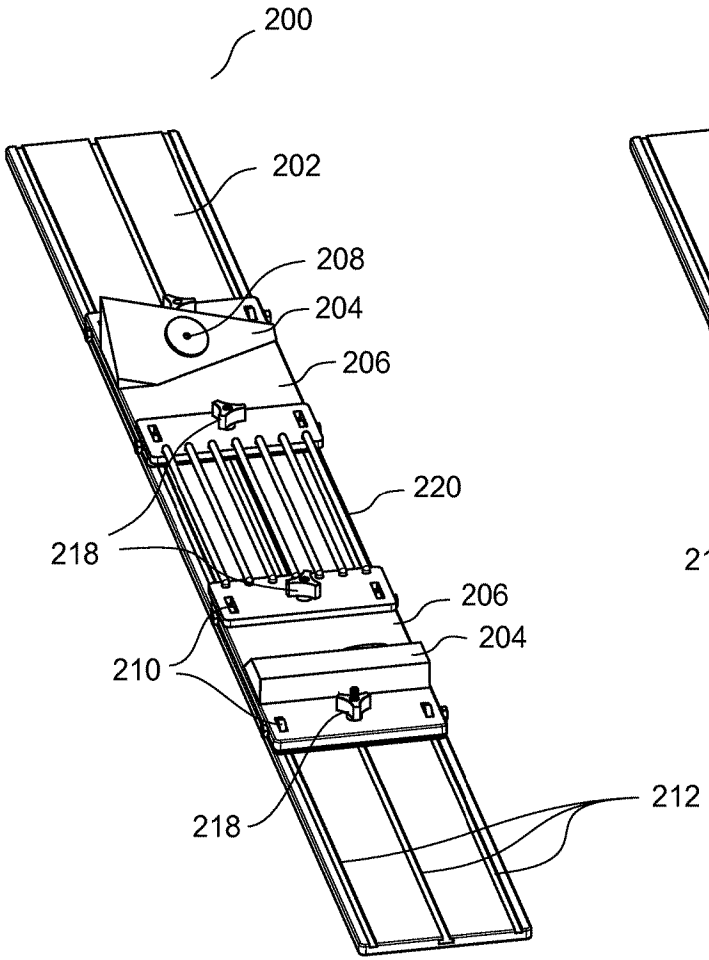
FIG. 11A is a diagram showing a dynamic training system in accordance with the invention.
Figure 12:
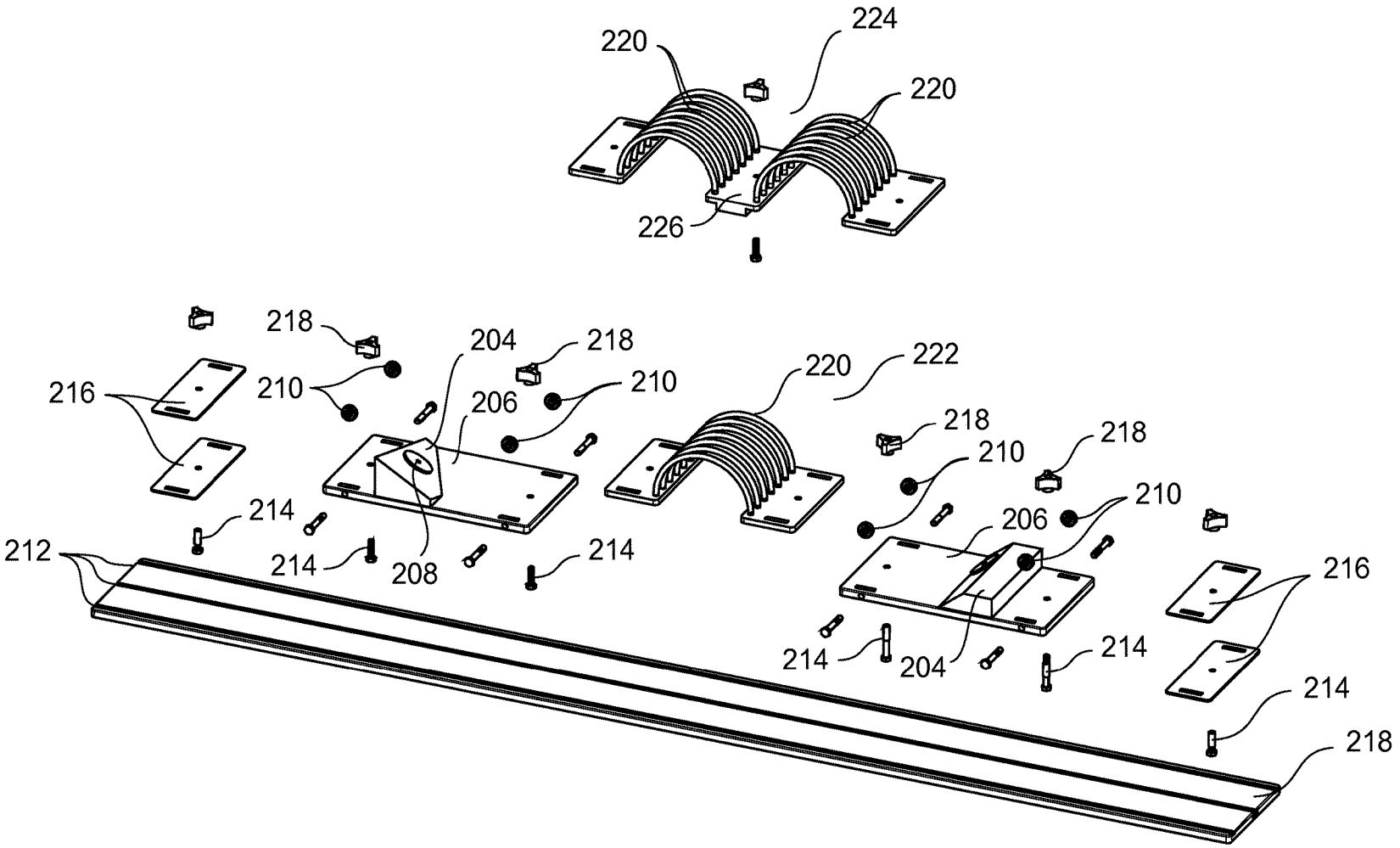
FIG. 12 is a diagram showing a dynamic training system in accordance with the invention.
Figure 18:
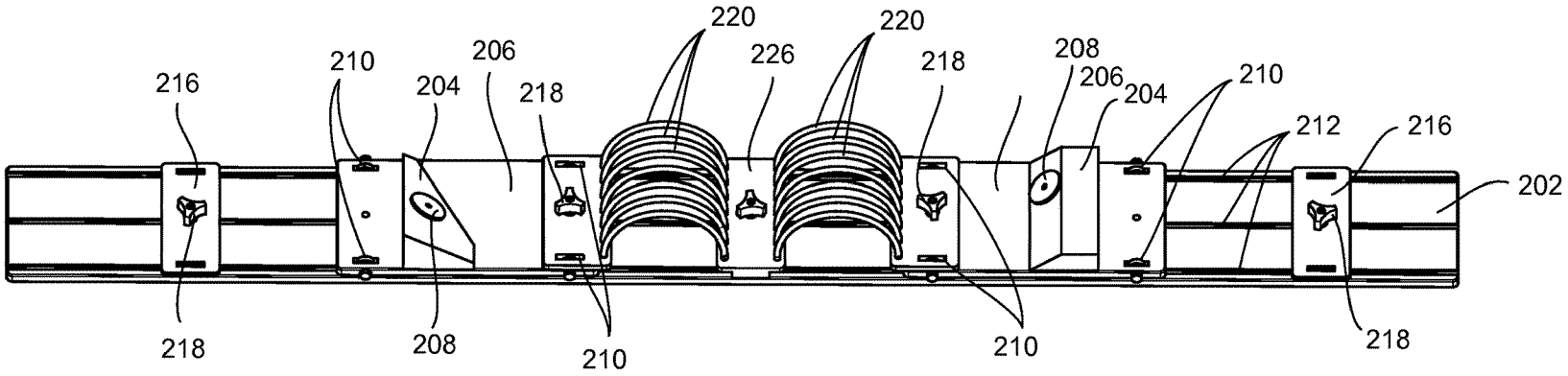
FIG. 18 is a diagram showing a dynamic training system in accordance with the invention.
Figure 19A:
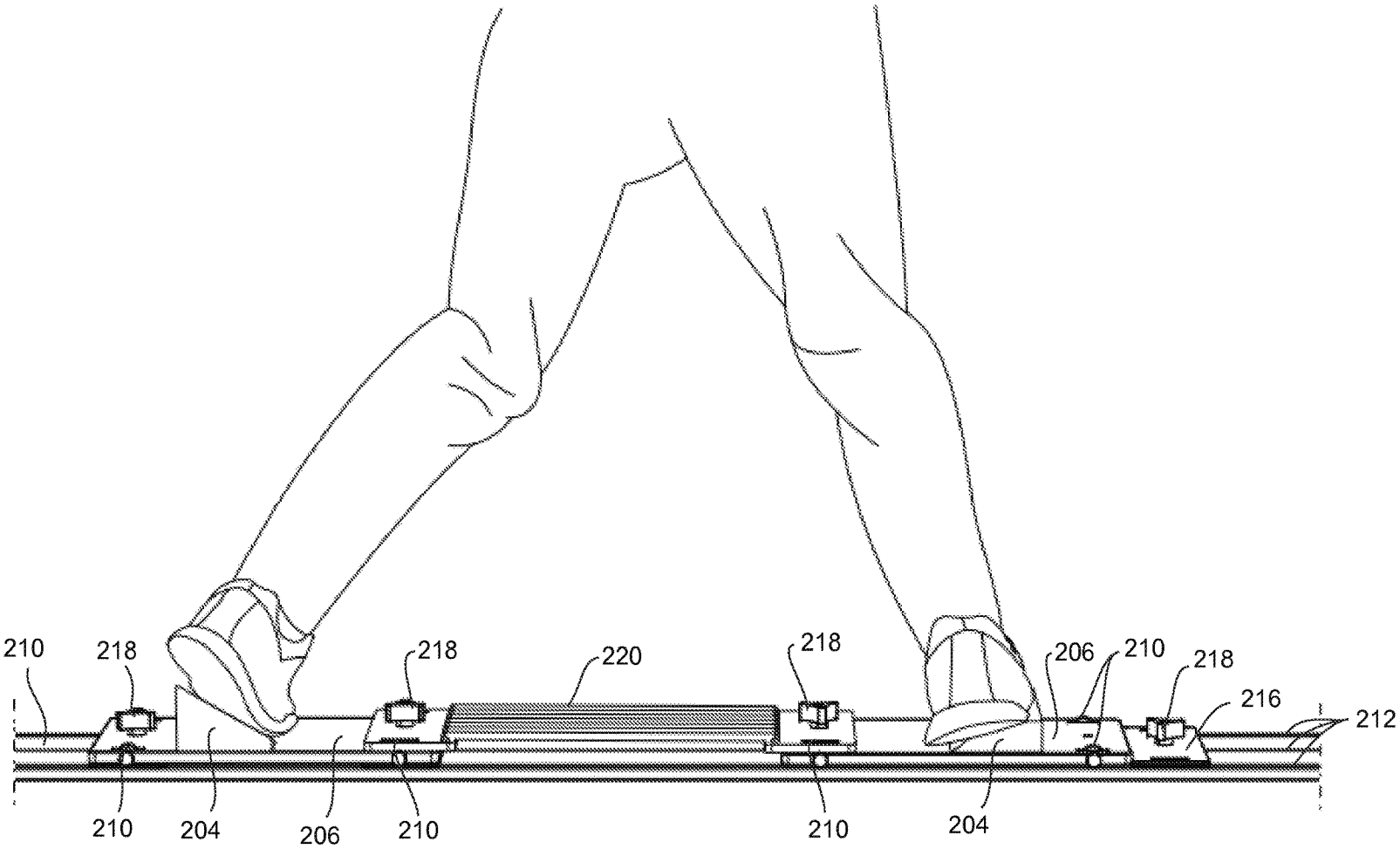
FIG. 19A is a diagram showing a dynamic training system in accordance with the invention in use.
Figure 19B:
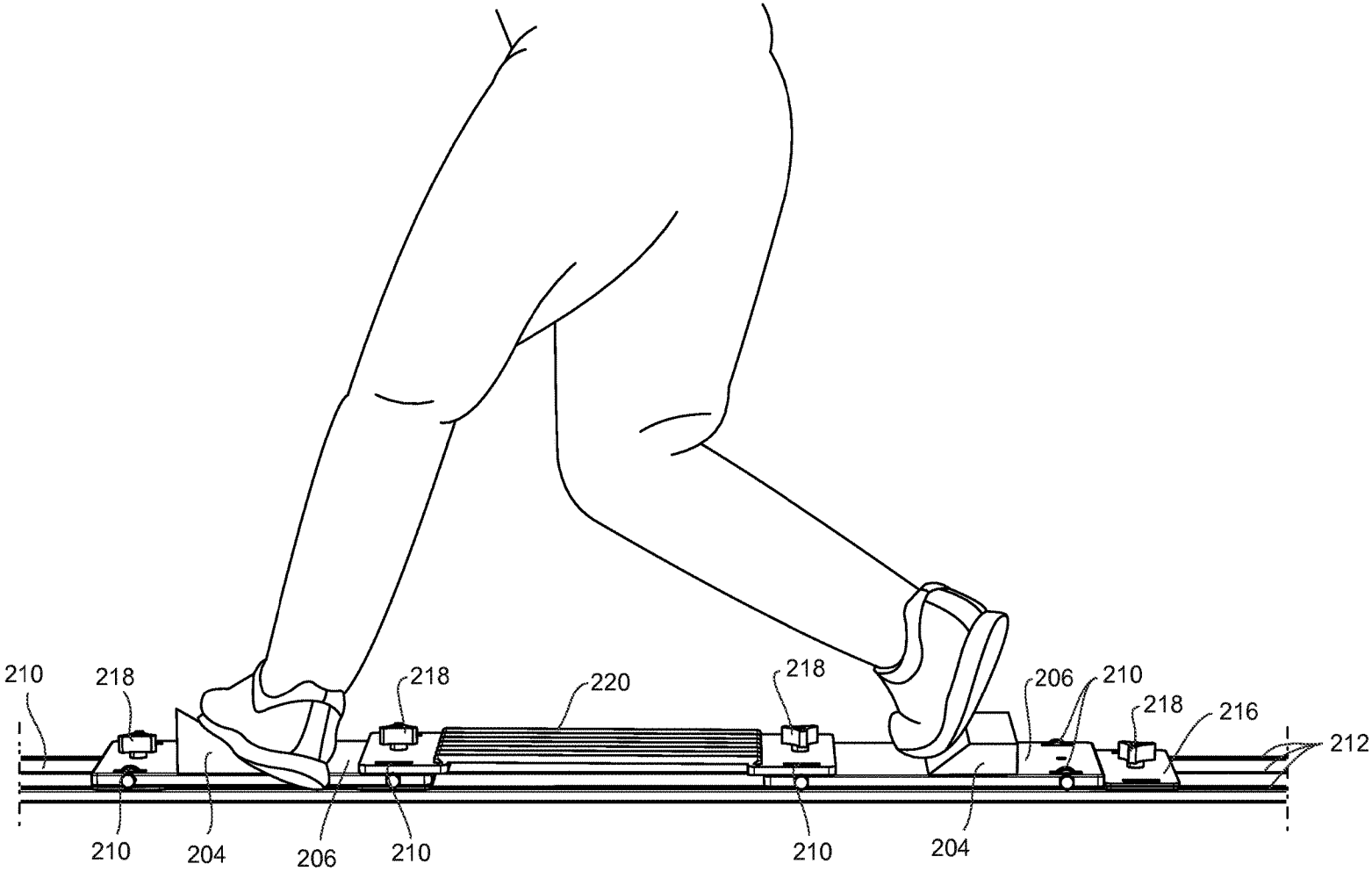
FIG. 19B is a diagram showing a dynamic training system in accordance with the invention in use.
Figure 19C:
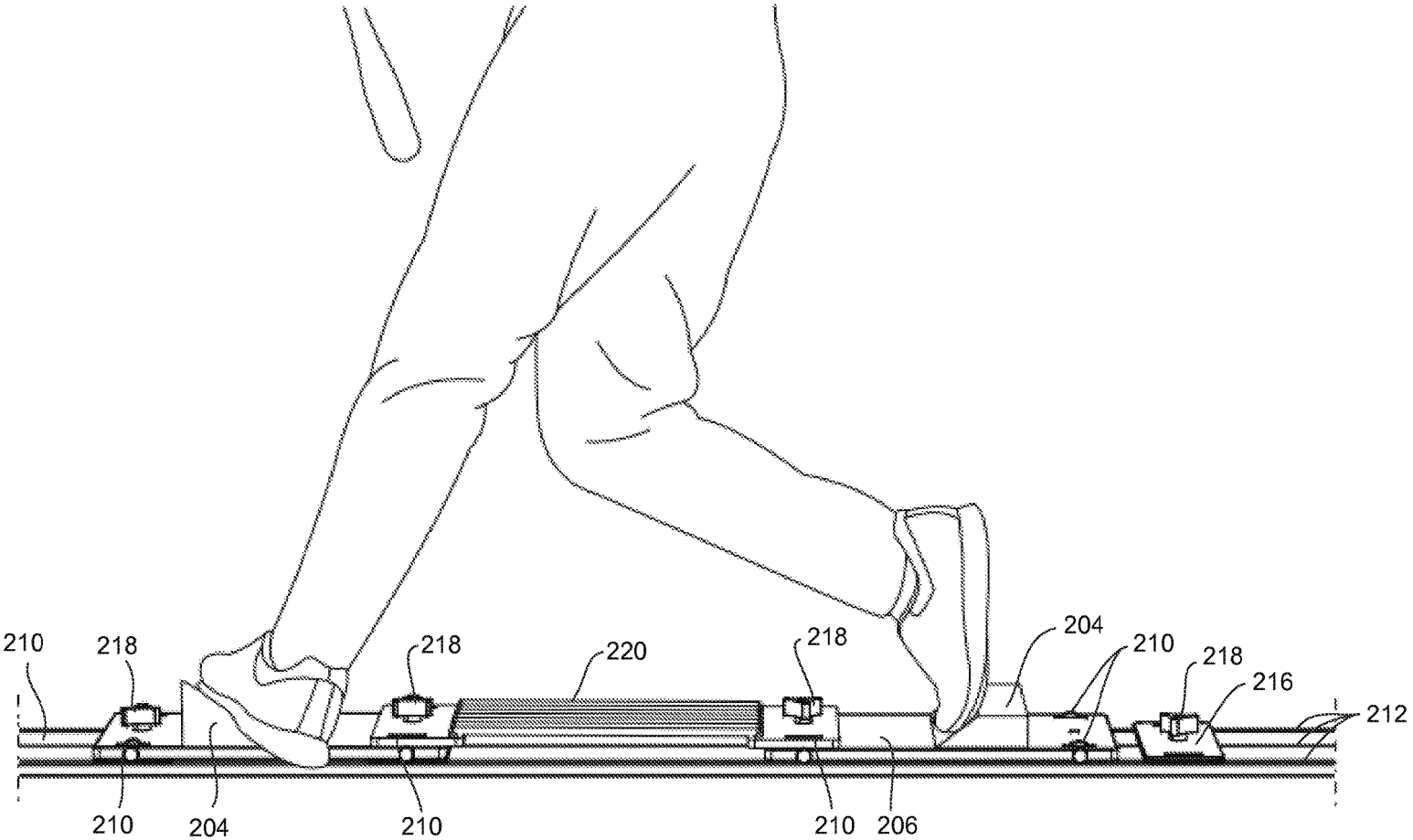
FIG. 19C is a diagram showing a dynamic training system in accordance with the invention in use.
Figure 19D:
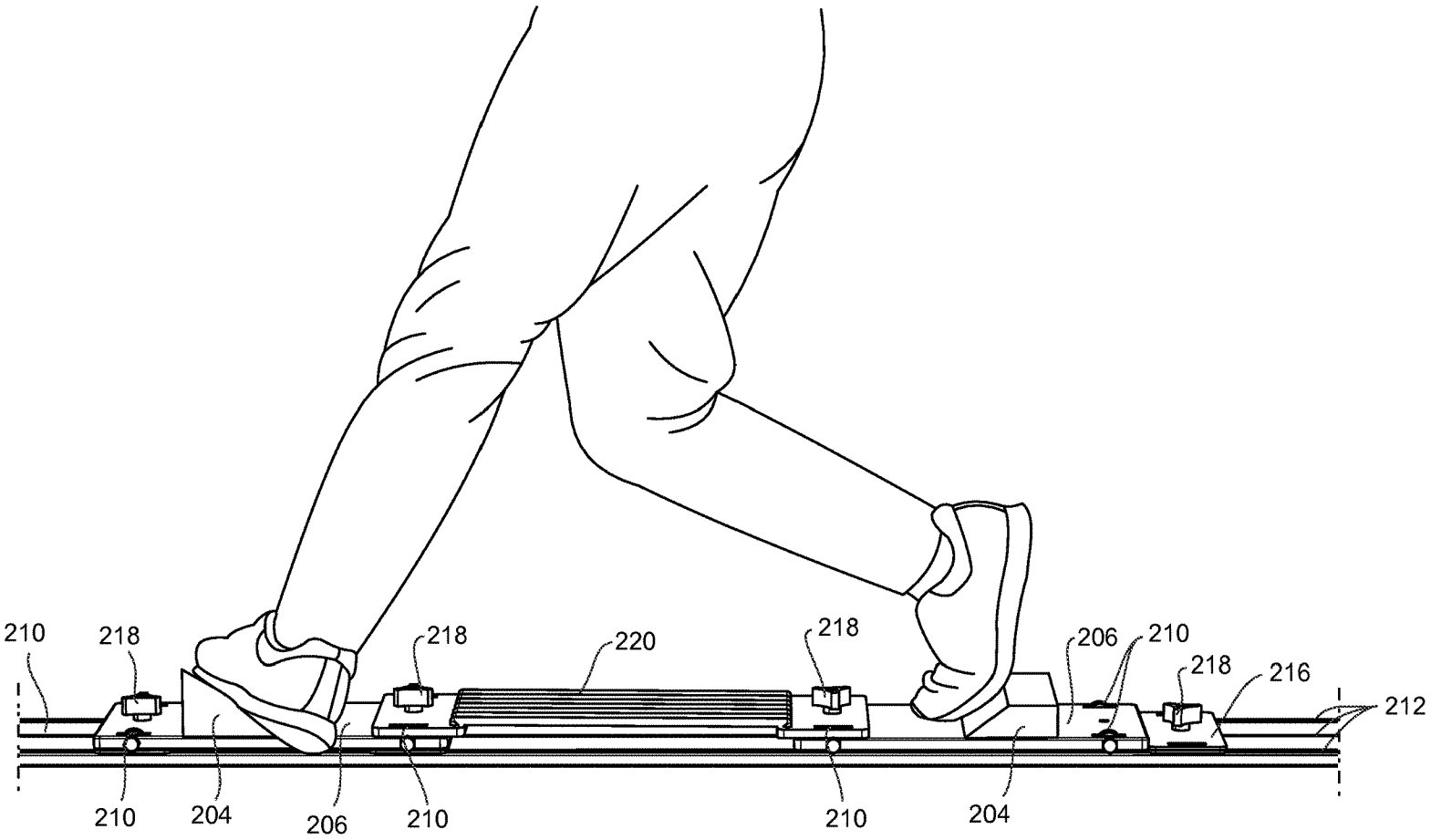
FIG. 19D is a diagram showing a dynamic training system in accordance with the invention in use.

Using such a system, skates 206 can be configured to move freely along the length of the track 202, or their movement can be constrained in a wide range of different ways. FIGS. 11A and 11B show two examples of different configurations. On the right, the skates 206 are fixed at specific locations on the track 202 for static training either by directly tightening skates 206 to the track 202 or by using brake plates/shims 216 placed under the skates to prevent operation of the bearings or wheels 210 as shown in FIG. 14. On the left, the skates 206 can be fixed by as discussed above or move freely along the track, but an array of elastic cords 220 has been affixed to both skates 206 by a self aligning bungee connector 222 so that the elastic cords extend between the two skates. When the elastic cords are slack the skates will move freely, but when the elastic cords are stretched they will resist further movement of the skates away from each other. As shown in FIGS. 12 and 18, in various exemplary embodiments a double self-aligning bungee connector 224 with a center island brake 226 can be used to provide the ability to obtain resistance in a single direction.

These systems are intended to be highly customizable. Various different potential configurations of brakes and self-aligning bungee connectors are shown throughout the Figures by way of example, and no limitation on the potential different configurations should be inferred.

Figure 20:
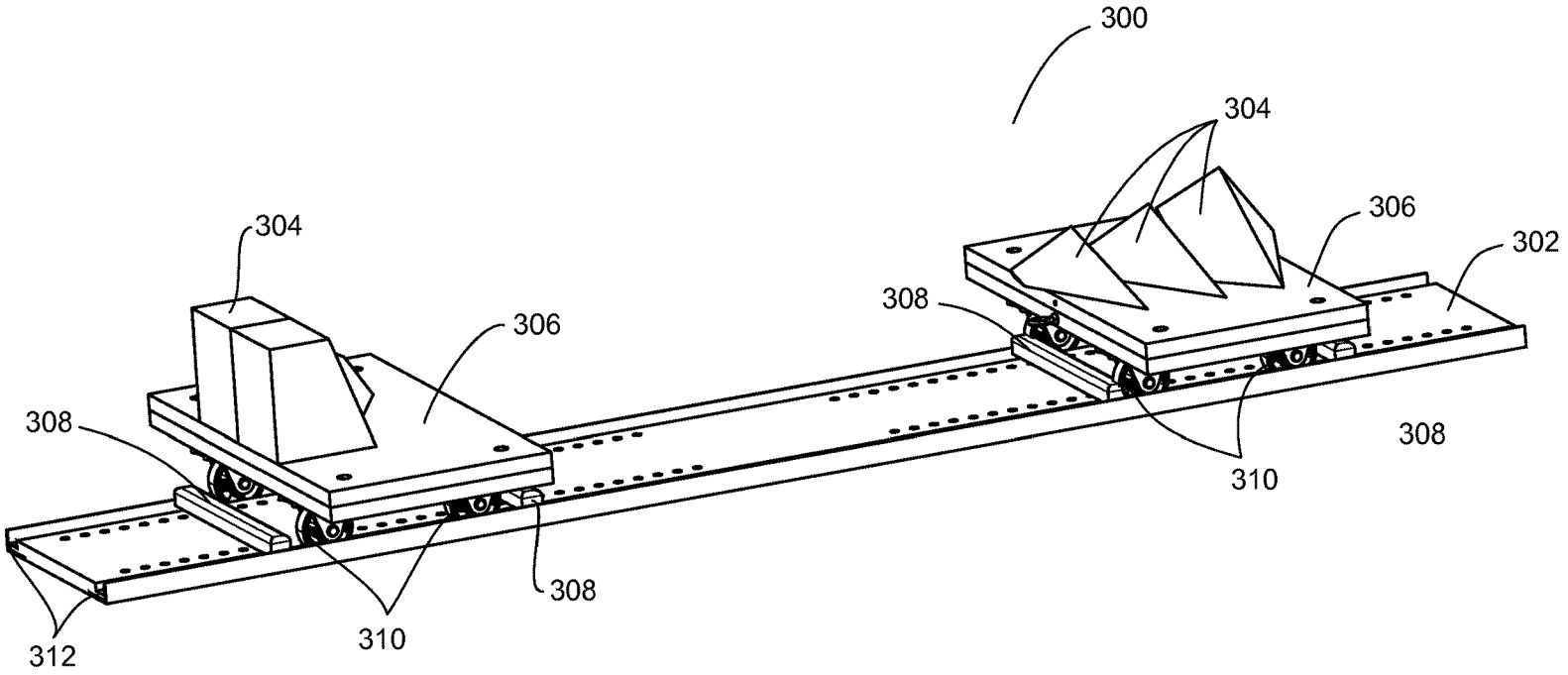
FIG. 20 is a diagram showing a dynamic training system in accordance with the invention.
Figure 21:
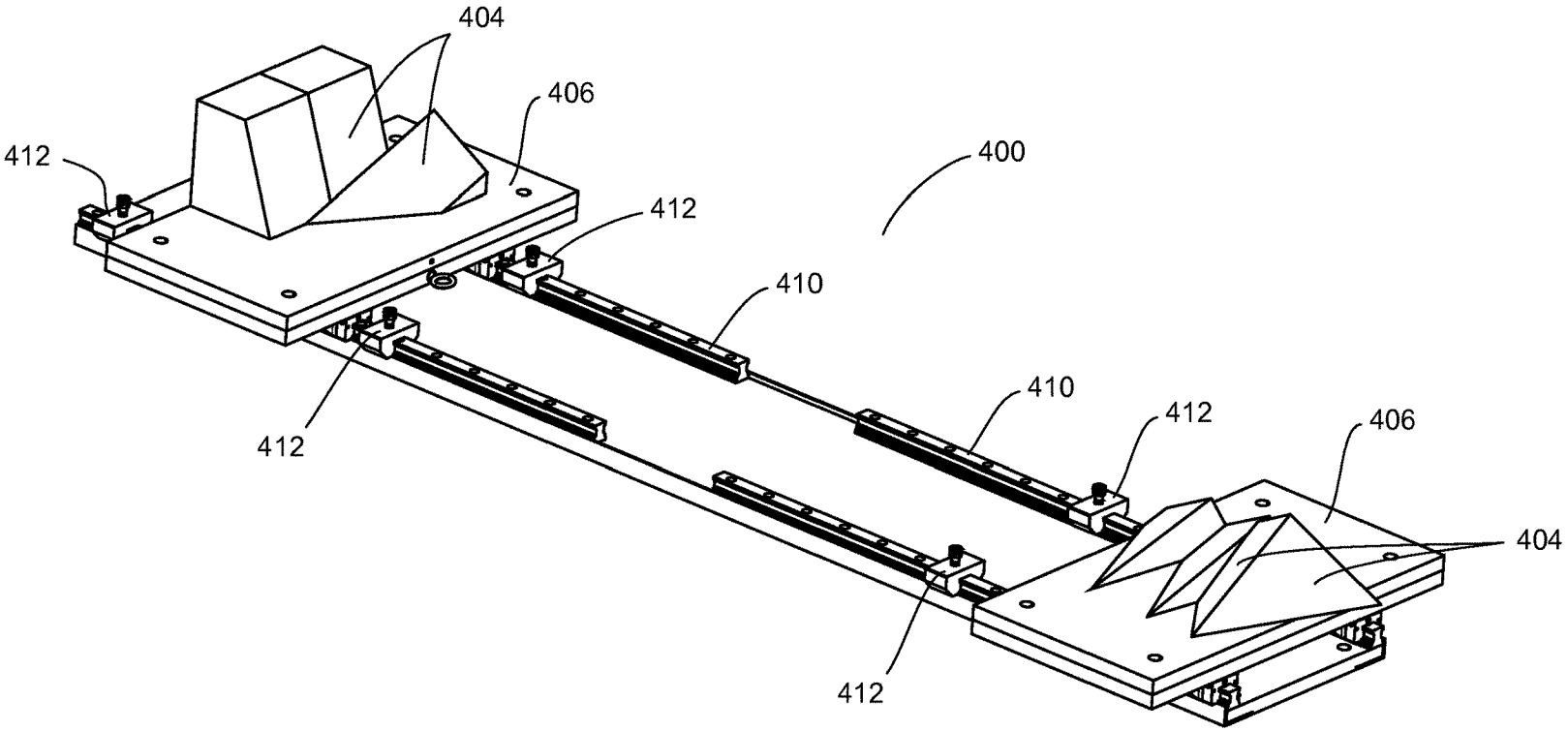
FIG. 21 is a diagram showing a dynamic training system in accordance with the invention.
Figure 22:
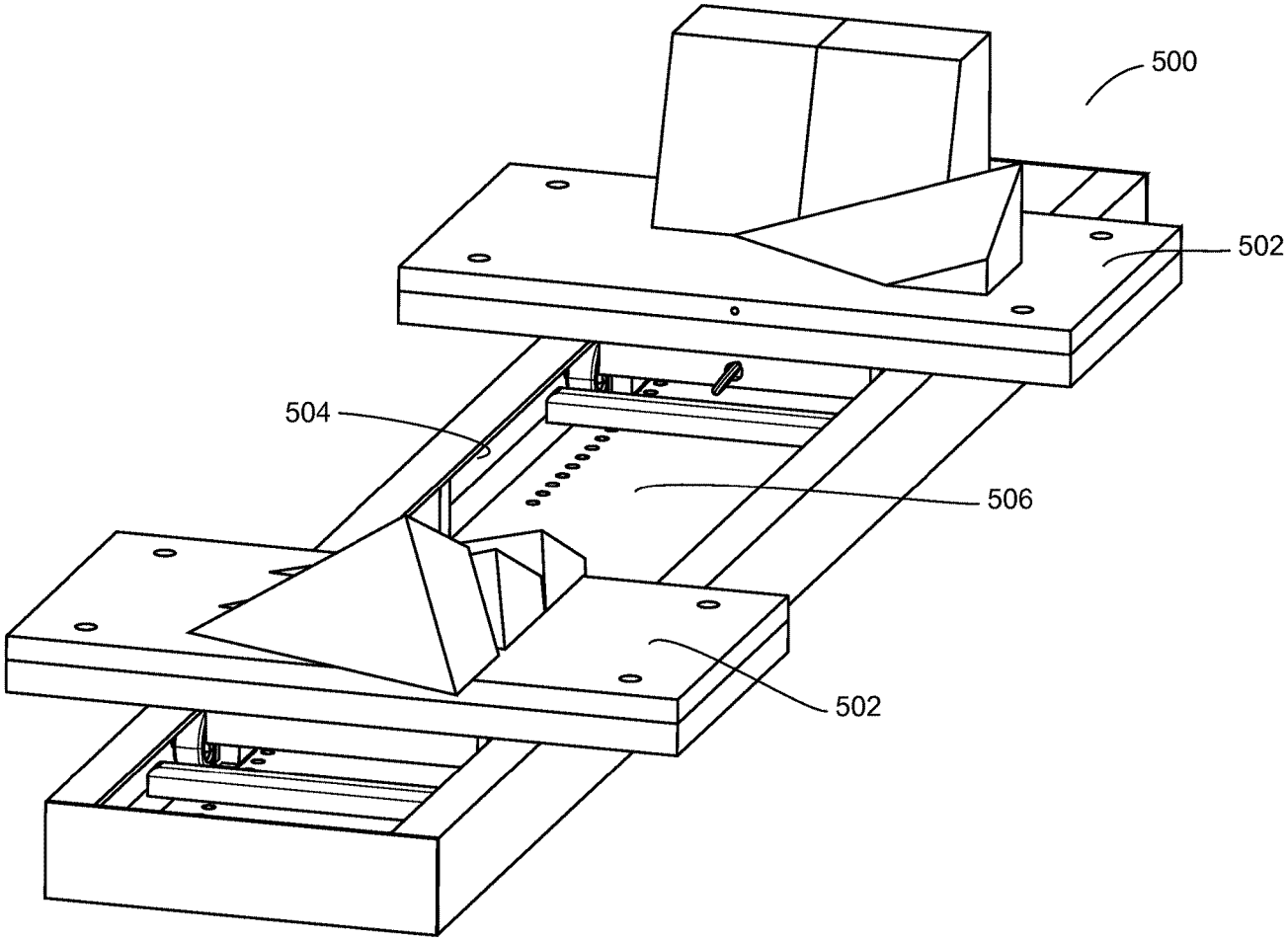
FIG. 22 is a diagram showing a dynamic training system in accordance with the invention.

With reference to FIGS. 20 through 22, different variations on the concept of the dynamic training system disclosed herein are provided. FIG. 20 shows an alternative exemplary embodiment of a dynamic training system 300 having a track 302 and foot blocks 304 on skates 306. The track is equipped with holes to which brakes 308 can be attached. The skates 306 ride on caster wheels 310 in channels 312 formed in the track or created by affixing angle irons to the track to form a channel at the edges of the track.

FIG. 21 is a perspective view of an exemplary embodiment of a dynamic system 400 with two moveable platforms 406 to which various sizes and shapes of foot blocks 404 can be attached. The track system 410 allows the user to set stops 412 at any desired location to constrain movement in either or both directions along the track. The movable platforms are affixed to the track via a track and slide mechanism wherein the track has a T-shaped extension that is engaged by complimentary guides affixed to the underside of the platform. This system allows the platforms to move axially along the longitudinal axis of the track, but they cannot move vertically off the track, or laterally/rotationally. In various exemplary embodiments, a similar system with a rotatable plate mounted on the moveable platform would allow rotational movement of the foot blocks while still constraining vertical and lateral movement of the platform.

FIG. 22 shows a further alternative embodiment of a dynamic training system 500 in which the skates 502 are constrained laterally within vertical channels 504 affixed to the sides of the track 506.

In various exemplary embodiments, the surface may have one or more T-tracks for moveable attachment of various breaks, stops, or other components, and one or more u-channel tracks for wheels or other guides. Bolts having a flange at the bottom that fits within the T-track can be used to slideably attach the various components to the surface, such that they can be moved along the T-track and then tightened to hold a particular position along the T-track.

Mechanisms such as skateboard wheel bearings, wheels, or other devices can be used to engage the u-channel tracks and allow the platforms to easily slide along the surface. Such wheels or bearings can be mounted internally through slots or grooves, or can be mounted at the edge of the platform. Various types of shims or plates can be used to adjust the height of different components along the surface.

In various exemplary embodiments, the track may be of any suitable size to allow substantially linear movement along the track. In various exemplary embodiments there are moveable or fixed stops on the track that allow the user to fix the location of the foot blocks on the track or allow the foot blocks to move within a fixed range of positions on the track. It will be readily understood that a wide range of track and slide systems could be used using wheels, ball bearings, low or limited friction surfaces, etc. In various exemplary embodiments, the sliding structure is retained in the track vertically and laterally to prevent it from leaving the track during use.

In various exemplary embodiments the dynamic system can also be used for strength training and conditioning. Resistance may be provided by any suitable arrangement of known resistance devices. For example, cables may be attached to one or more skates and connected to weights or other devices to provide resistance to movement. Thus, a dynamic training system in accordance with the present invention can be developed as an accessory to cable or strap based weight training systems, or equipped with its own weight training system. Different levels of resistance can be provided as appropriate to the specific resistance system, such as by increasing the number, arrangement, or elasticity of the bungees.

The various dynamic training systems disclosed herein can be arranged to allow for both feet to move or for just one side to move. For example, the front blocks may be fixed on the track and the rear blocks can move. The user must press the back blocks back and overcome the resistance of the bungee cord to establish a correct athletic load. The compound angle foot block on the rear base insures that the user correctly loads with the knee inside, while the compound angle foot block on the fixed front base puts the front foot and leg in the correct orientation.

In various configurations, as the user swings the back foot pivots as the plate slides forward, then drives the plate back as they follow through. The resistance drawing the rear plate forward forces the user to have a fast, precise, balanced transfer, bringing the entire lower body into the correct alignment for a balanced finish. In various alternatives the rear blocks may be fixed and the front blocks may move. This configuration trains the user to move the hip and knee joints of their front leg to position it correctly to push the block away and provide a firm front leg.

Training with the foot blocks disclosed herein helps train hitters to accomplish the combined movement of their front and back legs while keeping their head still and their eyes level so that that can focus on the incoming pitch. This is critical to hitting because it allows the hitter to see the ball better, and adjust to put the bat in the proper swing plane better.

All of the various components shown herein may be made from any suitable materials including wood, steel, fiberglass, plastic, etc. While the devices and methods described herein have been discussed in reference specifically to hitting, it will be readily understood that they can be used for training for a wide range of different sports and activities. With respect to baseball, the same devices and methods can be used to teach fundamental lower body positioning and movement for pitching, throwing, and fielding simply by varying the positioning and orientation of the foot blocks.

The devices and methods described herein can be used alone or in connection with other training devices, including without limitation the swing track devices and methods described in U.S. Provisional Patent Application No. 61/728,347 on Nov. 20, 2012 and in U.S. patent application Ser. No. 14/085,792.

What is claimed is:

1. A training apparatus comprising:

a base platform having a length and a top surface defined by edges, the top surface having a longitudinal axis and at least two or more tracks extending along the longitudinal axis of the base platform for at least a portion of the length of the base platform and set in from the edges of the base platform, each of the two or more tracks comprising a substantially u-shaped channel extending downward into the top surface of the base platform;

one or more movable skates, each movable skate comprising a generally horizontal planar top surface and one or more bearings or wheels extending downward from the planar top surface to engage the u-shaped channel of at least one of the two or more tracks such that lateral movement of the one or more bearings or wheels is constrained by the u-shaped channel but upward movement of the bearings or wheels is not constrained;

each of the one or more movable skates being configured to move along the longitudinal axis of the base platform and to flex under a weight applied thereon such that a bottom surface between the bearings or wheels contacts the top surface of the base platform between two of the two or more tracks such that the movable skate resists movement due to friction between the bottom surface of the movable skate between the bearings or wheels and the top surface of the base platform when the weight is applied.

2. The training device of claim 1, further comprising one or more brakes affixed at a plurality of one or more locations on the track, each brake comprising a block of material that extends laterally across the longitudinal axis of the base platform to block movement of at least one of the one or more movable skates along the longitudinal axis of the base platform.

3. The training device of claim 1, further comprising one or more elastic cords connecting the one or more movable skates to provide resistance to movement of the movable skates in at least one direction.

4. The training device of claim 1, further comprising one or more foot blocks comprising hollow or solid blocks of material with a generally rigid, planar, non-horizontal top surface, each of the one or more foot blocks being removably attached to the one or more movable skates.

5. The training device of claim 4, wherein the generally non-horizontal planar top surface of at least one of the foot blocks is at a compound angle.

6. The training device of claim 5, wherein the compound angle is oriented such that the ball of the user's foot is lower than the heel and in contact with the top surface of the movable skate.

7. The training device of claim 1, wherein the bearings or wheels are located within the one or more movable skates.

8. The training device of claim 7, wherein the bearings or wheels are set in from the edge of the one or more moveable skates and extend vertically through the top surface of the one or more movable skates such that the one or more moveable skates is positioned at approximately the vertical mid-point on the bearings or wheels.

9. The training device of claim 2, each of the one or more brakes further comprising a bolt that passes through the block of material and positioned in a t-channel on the base and tightened to fix the position each of the one or more brakes.

10. The training device of claim 9, further comprising one or more shims configured to be stacked with the block of material to create a physical barrier to movement along the at least two or more tracks.

11. The training device of claim 1, further comprising one or more shims configured to be stacked under the one or more skates to prevent movement along the at least two or more one or more tracks.

12. The training device of claim 1, further comprising one or more shims configured to be stacked under the one or more skates to adjust the height of the wheels or bearings sufficient to raise the wheels or bearings out of the respective u-shaped channel of at least one of the two or more tracks.

13. The training device of claim 3, wherein the one or more elastic cords are configured to extend upward such that they will not block movement of the one or more skates.

14. The training device of claim 1, wherein the one or more movable skates are configured to be affixed at a plurality of locations on the at least one of the two or more tracks.

* * * * *